US007428190B2

(12) United States Patent
Sano

(10) Patent No.: US 7,428,190 B2
(45) Date of Patent: Sep. 23, 2008

(54) TIME RECEPTION APPARATUS AND WAVE CLOCK

(75) Inventor: Takashi Sano, Fussa (JP)

(73) Assignee: Casio Computer Co., Ltd., Tokyo (JP)

( * ) Notice: Subject to any disclaimer, the term of this patent is extended or adjusted under 35 U.S.C. 154(b) by 127 days.

(21) Appl. No.: 11/595,478

(22) Filed: Nov. 10, 2006

(65) Prior Publication Data

US 2007/0115759 A1 May 24, 2007

(30) Foreign Application Priority Data

Nov. 22, 2005 (JP) ..... 2005-336980

(51) Int. Cl.
*G04C 11/02* (2006.01)

(52) U.S. Cl. ..... 368/47

(58) Field of Classification Search ..... 368/46, 368/47, 56, 57

See application file for complete search history.

(56) References Cited

U.S. PATENT DOCUMENTS 5,861,818 A * 1/1999 Ohtsuki ..... 340/7.52
6,044,106 A * 3/2000 Suzuki ..... 375/219
6,166,651 A * 12/2000 Kushita ..... 340/7.1
2003/0117902 A1* 6/2003 Suzuki et al. ..... 368/47
2003/0198140 A1* 10/2003 Shimizu ..... 368/47
2005/0185514 A1* 8/2005 Ihara et al. ..... 368/47
2005/0259518 A1* 11/2005 Saitoh ..... 368/47
2006/0153008 A1* 7/2006 Miyamatsu et al. ..... 368/47
2006/0187757 A1* 8/2006 Ihashi ..... 368/47

FOREIGN PATENT DOCUMENTS

JP 2003-222687 A 8/2003

* cited by examiner

*Primary Examiner*—Edwin A. Leon
*Assistant Examiner*—Thanh S Phan
(74) *Attorney, Agent, or Firm*—Frishauf, Holtz, Goodman & Chick, P.C.

(57) ABSTRACT

Code data indicated by a time code signal is judged according to the kind of a standard frequency broadcast to be received at the time of decoding the time code signal. For example, in the case of receiving a JJY standard frequency broadcast, the time code signal falls at time points t21 and t23 in a second period T2, and the code data indicated by the time code signal in the second period T2 is judged based on the time point t23 at which the time code signal falls last between the time points t21 and t23. Thereby, even if a lot of noise components are included in a reception signal, the pertinently detection of the time information is enabled.

10 Claims, 23 Drawing Sheets

FIG. 3

| SECOND | 0 | 1 | 2 | 3 | 4 | 5 | 6 | 7 | 8 | 9 | 10 | 11 | 12 | 13 | 14 | 15 | 16 | 17 | 18 | 19 |
|---|---|---|---|---|---|---|---|---|---|---|---|---|---|---|---|---|---|---|---|---|
| JJY (JAPAN) | P | 40m | 20m | 10m | 0 | 8m | 4m | 2m | 1m | P1 | 0 | 0 | 20h | 10h | 0 | 8h | 4h | 2h | 1h | P2 |
| | M | TEN MINUTE COLUMN | | | EXPAN-SION | ONE MINUTE COLUMN | | | | MARK-ER | EXPANSION | | TEN HOUR COLUMN | | EXPAN-SION | ONE HOUR COLUMN | | | | MARK-ER |

| SECOND | 20 | 21 | 22 | 23 | 24 | 25 | 26 | 27 | 28 | 29 | 30 | 31 | 32 | 33 | 34 | 35 | 36 | 37 | 38 | 39 |
|---|---|---|---|---|---|---|---|---|---|---|---|---|---|---|---|---|---|---|---|---|
| JJY (JAPAN) | 0 | 0 | 200d | 100d | 0 | 80d | 40d | 20d | 10d | P3 | 8d | 4d | 2d | 1d | 0 | 0 | PA1 | PA2 | SU1 | P4 |
| | EXPANSION | | HUNDRED DAY COLUMN | | EXPAN-SION | TEN DAY COLUMN | | | | MARK-ER | ONE DAY COLUMN | | | | EXPANSION | | HOUR PARITY | MINUTE PARITY | SUMMER SPARE | MARK-ER |

| SECOND | 40 | 41 | 42 | 43 | 44 | 45 | 46 | 47 | 48 | 49 | 50 | 51 | 52 | 53 | 54 | 55 | 56 | 57 | 58 | 59 |
|---|---|---|---|---|---|---|---|---|---|---|---|---|---|---|---|---|---|---|---|---|
| JJY (JAPAN) | SU2 | 80y | 40y | 20y | 10y | 8y | 4y | 2y | 1y | P5 | 4W | 2W | 1W | LS1 | LS2 | 0 | 0 | 0 | 0 | P0 |
| | SUMMER EXECUTION | TEN YEAR COLUMN | | | | ONE YEAR COLUMN | | | | MARK-ER | DAY OF WEEK | | | LEAP SECOND | | EXPANSION | | | | MARK-ER |

FIG. 7

| SECOND | 0 | 1 | 2 | 3 | 4 | 5 | 6 | 7 | 8 | 9 | 10 | 11 | 12 | 13 | 14 | 15 | 16 | 17 | 18 | 19 |
|---|---|---|---|---|---|---|---|---|---|---|---|---|---|---|---|---|---|---|---|---|
| WWVB (AMERICA) | P | 40m | 20m | 10m | 0 | 8m | 4m | 2m | 1m | P1 | 0 | 0 | 20h | 10h | 0 | 8h | 4h | 2h | 1h | P2 |
| | M | TEN MINUTE COLUMN | | | EXPAN-SION | ONE MINUTE COLUMN | | | | MARK-ER | EXPANSION | | TEN HOUR COLUMN | | EXPAN-SION | ONE HOUR COLUMN | | | | MARK-ER |

| SECOND | 20 | 21 | 22 | 23 | 24 | 25 | 26 | 27 | 28 | 29 | 30 | 31 | 32 | 33 | 34 | 35 | 36 | 37 | 38 | 39 |
|---|---|---|---|---|---|---|---|---|---|---|---|---|---|---|---|---|---|---|---|---|
| WWVB (AMERICA) | 0 | 0 | 200d | 100d | 0 | 80d | 40d | 20d | 10d | P3 | 8d | 4d | 2d | 1d | 0 | 0 | ADD | SUB | ADD | P4 |
| | EXPANSION | | HUNDRED DAY COLUMN | | EXPAN-SION | TEN DAY COLUMN | | | | MARK-ER | ONE DAY COLUMN | | | | EXPANSION | | DUT/CODE | | | MARK-ER |

| SECOND | 40 | 41 | 42 | 43 | 44 | 45 | 46 | 47 | 48 | 49 | 50 | 51 | 52 | 53 | 54 | 55 | 56 | 57 | 58 | 59 |
|---|---|---|---|---|---|---|---|---|---|---|---|---|---|---|---|---|---|---|---|---|
| WWVB (AMERICA) | 0.8 | 0.4 | 0.2 | 0.1 | 0 | 80y | 40y | 20y | 10y | P5 | 8y | 4y | 2y | 1y | 0 | LY | LS | SU1 | SU2 | P0 |
| | DUT1 | | | | EXPAN-SION | TEN YEAR COLUMN | | | | MARK-ER | ONE YEAR COLUMN | | | | EXPAN-SION | LEAP YEAR | LEAP SECOND | SUMMER TIME | | MARK-ER |

FIG. 10

| SECOND | 0 | 1 | 2 | 3 | 4 | 5 | 6 | 7 | 8 | 9 | 10 | 11 | 12 | 13 | 14 | 15 | 16 | 17 | 18 | 19 |
|---|---|---|---|---|---|---|---|---|---|---|---|---|---|---|---|---|---|---|---|---|
| DCF77 (GERMANY) | 0 | 0 | 0 | 0 | 0 | 0 | 0 | 0 | 0 | 0 | 0 | 0 | 0 | 0 | 0 | R | A1 | Z1 | Z2 | A2 |
| | M | EXPANSION | | | | | | | | | | | | | | ANTENNA | SUMMER SPARE | SUMMER EXECUTION | | LEAP SECOND |

| SECOND | 20 | 21 | 22 | 23 | 24 | 25 | 26 | 27 | 28 | 29 | 30 | 31 | 32 | 33 | 34 | 35 | 36 | 37 | 38 | 39 |
|---|---|---|---|---|---|---|---|---|---|---|---|---|---|---|---|---|---|---|---|---|
| DCF77 (GERMANY) | S | 1m | 2m | 4m | 8m | 10m | 20m | 40m | P1 | 1h | 2h | 4h | 8h | 10h | 20h | P2 | 1d | 2d | 4d | 8d |
| | START | ONE MINUTE COLUMN | | | | TEN MINUTE COLUMN | | | MINUTE PARITY | ONE HOUR COLUMN | | | | TEN HOUR COLUMN | | HOUR PARITY | ONE DAY COLUMN | | | |

| SECOND | 40 | 41 | 42 | 43 | 44 | 45 | 46 | 47 | 48 | 49 | 50 | 51 | 52 | 53 | 54 | 55 | 56 | 57 | 58 | 59 |
|---|---|---|---|---|---|---|---|---|---|---|---|---|---|---|---|---|---|---|---|---|
| DCF77 (GERMANY) | 10d | 20d | 1W | 2W | 4W | 1M | 2M | 4M | 8M | 10M | 1y | 2y | 4y | 8y | 10y | 20y | 40y | 80y | P3 | — |
| | TEN DAY COLUMN | | DAY OF WEEK | | | ONE DAY COLUMN | | | | TEN DAY COLUMN | ONE YEAR COLUMN | | | | TEN YEAR COLUMN | | | | DAY PARITY | MARK-ER |

920

| STANDARD ELECTRIC WAVE CLASSIFICATION | DETECTION POSITIONS OF CHANGE POINTS | | | | |
|---|---|---|---|---|---|
| | 0 | 1 | P | MARKER | |
| JJY (40kHz:JAPAN) | 700-900 ms | 400-600 ms | 100-300 ms | — | L11 |
| JJY (60kHz:JAPAN) | 700-900 ms | 400-600 ms | 100-300 ms | — | L13 |
| WWVB (AMERICA) | 100-300 ms | 400-600 ms | 700-900 ms | — | L15 |
| DCF77 (GERMANY) | 100-150 ms | 150-300 ms | — | NO CHANGE POINTS IN 100-300 ms | L17 |

FIG. 15A

| CHANGE PATTERN | | | CODE DATA |
|---|---|---|---|
| 100-300 ms | 400-600 ms | 700-900 ms | |
| UNCHANGED | UNCHANGED | UNCHANGED | ERROR |
| UNCHANGED | UNCHANGED | CHANGED | 0 |
| UNCHANGED | CHANGED | UNCHANGED | 1 |
| UNCHANGED | CHANGED | CHANGED | 0 |
| CHANGED | UNCHANGED | UNCHANGED | P |
| CHANGED | UNCHANGED | CHANGED | 0 |
| CHANGED | CHANGED | UNCHANGED | 1 |
| CHANGED | CHANGED | CHANGED | 0 |

L21
L22
L23

FIG. 15B

| CHANGE PATTERN | | | CODE DATA |
|---|---|---|---|
| 100-300 ms | 400-600 ms | 700-900 ms | |
| UNCHANGED | UNCHANGED | UNCHANGED | ERROR |
| UNCHANGED | UNCHANGED | CHANGED | 0 |
| UNCHANGED | CHANGED | UNCHANGED | 1 |
| UNCHANGED | CHANGED | CHANGED | 0 |
| CHANGED | UNCHANGED | UNCHANGED | P |
| CHANGED | UNCHANGED | CHANGED | P |
| CHANGED | CHANGED | UNCHANGED | 1 |
| CHANGED | CHANGED | CHANGED | ERROR |

L24

FIG. 16A

| CHANGE PATTERN | | | CODE DATA |
|---|---|---|---|
| 100-300 ms | 400-600 ms | 700-900 ms | |
| UNCHANGED | UNCHANGED | UNCHANGED | ERROR |
| UNCHANGED | UNCHANGED | CHANGED | P |
| UNCHANGED | CHANGED | UNCHANGED | 1 |
| UNCHANGED | CHANGED | CHANGED | P |
| CHANGED | UNCHANGED | UNCHANGED | 0 |
| CHANGED | UNCHANGED | CHANGED | P |
| CHANGED | CHANGED | UNCHANGED | 1 |
| CHANGED | CHANGED | CHANGED | P |

L25

FIG. 16B

| CHANGE PATTERN | | | CODE DATA |
|---|---|---|---|
| 100-300 ms | 400-600 ms | 700-900 ms | |
| UNCHANGED | UNCHANGED | UNCHANGED | ERROR |
| UNCHANGED | UNCHANGED | CHANGED | P |
| UNCHANGED | CHANGED | UNCHANGED | 1 |
| UNCHANGED | CHANGED | CHANGED | P |
| CHANGED | UNCHANGED | UNCHANGED | 0 |
| CHANGED | UNCHANGED | CHANGED | 0 |
| CHANGED | CHANGED | UNCHANGED | 1 |
| CHANGED | CHANGED | CHANGED | ERROR |

L26

FIG. 17

| CHANGE PATTERN | | CODE DATA |
|---|---|---|
| 100-150 ms | 150-300 ms | |
| UNCHANGED | UNCHANGED | MARKER |
| UNCHANGED | CHANGED | 1 |
| CHANGED | UNCHANGED | 0 |
| CHANGED | CHANGED | ERROR |

FIG. 23

| STANDARD ELECTRIC WAVE CLASSIFICATION | THRESHOLDLEVEL | |
|---|---|---|
| JJY (40kHz:JAPAN) | STANDARD VALUE | L31 |
| JJY (60kHz:JAPAN) | STANDARD VALUE | |
| WWVB (AMERICA) | STANDARD VALUE×1.1 | L33 |
| DCF77 (GERMANY) | STANDARD VALUE×0.9 | L35 |

FIG. 25

| DETECTION METHOD OF CHANGE POINT AT TIME OF TIME CODE DECODING | THRESHOLDLEVEL | |
|---|---|---|
| DETECTION OF CHANGE POINT AT WHICH TIME CODE SIGNAL CHANGES LAST IN SECOND PERIOD | STANDARD VALUE×1.1 | L41 |
| DETECTION OF CHANGE POINT AT WHICH TIME CODE SIGNAL CHANGES FIRST IN SECOND PERIOD | STANDARD VALUE×0.9 | L43 |

FIG. 27

| STANDARD ELECTRIC WAVE CLASSIFICATION | THRESHOLDLEVEL | |
|---|---|---|
| JJY (40kHz:JAPAN) | INTERMEDIATE VALUE OF PEAK VALUE AND BOTTOM VALUE OF DETECTION SIGNAL | L51 |
| JJY (60kHz:JAPAN) | INTERMEDIATE VALUE OF PEAK VALUE AND BOTTOM VALUE OF DETECTION SIGNAL | |
| WWVB (AMERICA) | INTERMEDIATE VALUE×1.1 | L53 |
| DCF77 (GERMANY) | INTERMEDIATE VALUE×0.9 | L55 |

TIME RECEPTION APPARATUS AND WAVE CLOCK

CROSS-REFERENCE TO RELATED APPLICATIONS

This application is based upon and claims the benefit of priority from the prior Japanese Patent Application No. 2005-336980, filed on Nov. 22, 2005, the entire contents of which are incorporated herein by reference.

BACKGROUND OF THE INVENTION

1. Field of the Invention

The present invention relates to a time reception apparatus and a wave clock.

2. Description of Related Art

Time information, a low frequency standard-time and frequency-signal broadcast (hereinafter simply referred to as a "standard frequency broadcast") including time information, i.e. a time code, is currently broadcasted in each country of Japan, United States, Germany and the like. As a kind of a time reception apparatus to receive the standard frequency broadcast, a wave clock which corrects a counting time has been put into practical use.

Moreover, as a technique for preventing the false detection of the time information owing to noise components intermixed into a reception signal, there is known a technique of judging the waveform of the reception signal by sampling a demodulation result of the reception signal and smoothing the demodulated signal, and of detecting the time information (see JP 2003-222687A). To put it concretely, a period of the data transmitted in every second (second data) is divided into a plurality of sections at the time of coding a received standard frequency broadcast, and the sampling of each of the divided sections is performed. When the pieces of the same sampled data can be acquired by a predetermined number or more, the section is judged to be "High" or "Low." Then, the second data is coded based on a combination pattern of the judgment results of the respective sections.

However, according to the technique disclosed in the JP 2003-222687A, when a combination pattern of the judgment results of "High" or "Low" in the plurality of sections in a period of the second data does not agree with any predetermined combinations, the second data is judged to be an error. Consequently, the technique has a problem of the impossibility of the detection of time information when the reception state of the time information is bad and a lot of noises are included in a reception signal.

The present invention was made in consideration of the problem in earlier development, and it is an object of the present invention to make it possible to detect time information appropriately even if noise components are much included in a reception signal.

SUMMARY OF THE INVENTION

In order to solve the problem, according to one aspect of the invention, a standard frequency broadcast including time information composed of a plurality of pieces of data divided in every second is received, waveform shaping of the received standard frequency broadcast into a time code signal expressed by binaries divided in every second is performed. A change point at which the time code signal having been subjected to the waveform shaping changes in one of the above divided periods is detected, and a time from the start of the period to the change point is calculated. Then, the data in the periods divided in a second is judged based on the calculated time, and the time code signal having been subjected to the waveform shaping by the waveform shaping unit is decoded. Moreover, the time indicated by the time information is extracted in accordance with the decoded result.

BRIEF DESCRIPTION OF THE DRAWINGS

FIG. 3 is a diagram showing a time code system of a JJY standard frequency broadcast;

FIG. 7 is a diagram showing a time code system of a WWVB standard frequency broadcast;

FIG. 10 is a diagram showing a time code system of a DCF77 standard frequency broadcast;

FIGS. 15A and 15B are diagrams showing modified examples of the data configuration of the code correspondence table for the JJY standard frequency broadcast;

FIGS. 16A and 16B are diagrams showing modified examples of the data configuration of the code correspondence table for the WWVB standard frequency broadcast;

FIG. 17 is a diagram showing a modified example of the data configuration of the code correspondence table for the DCF77 standard frequency broadcast;

FIG. 23 is a diagram showing an adjustment example of a threshold level;

FIG. 25 is a diagram showing an adjustment example (modified example) of a threshold level;

FIG. 27 is a diagram showing an adjustment example (modified example) of a threshold level.

DETAILED DESCRIPTION OF THE PREFERRED EMBODIMENTS

In the following, the preferred embodiments of the present invention will be described in detail with reference to FIGS. 1-27. In addition, although a wave clock to which the present invention is applied is exemplified in the following, the present invention can be also applied to the other apparatus for receiving electric waves similarly.

First Embodiment

First, a first embodiment is described.

[Functional Configuration]

Figure 1:
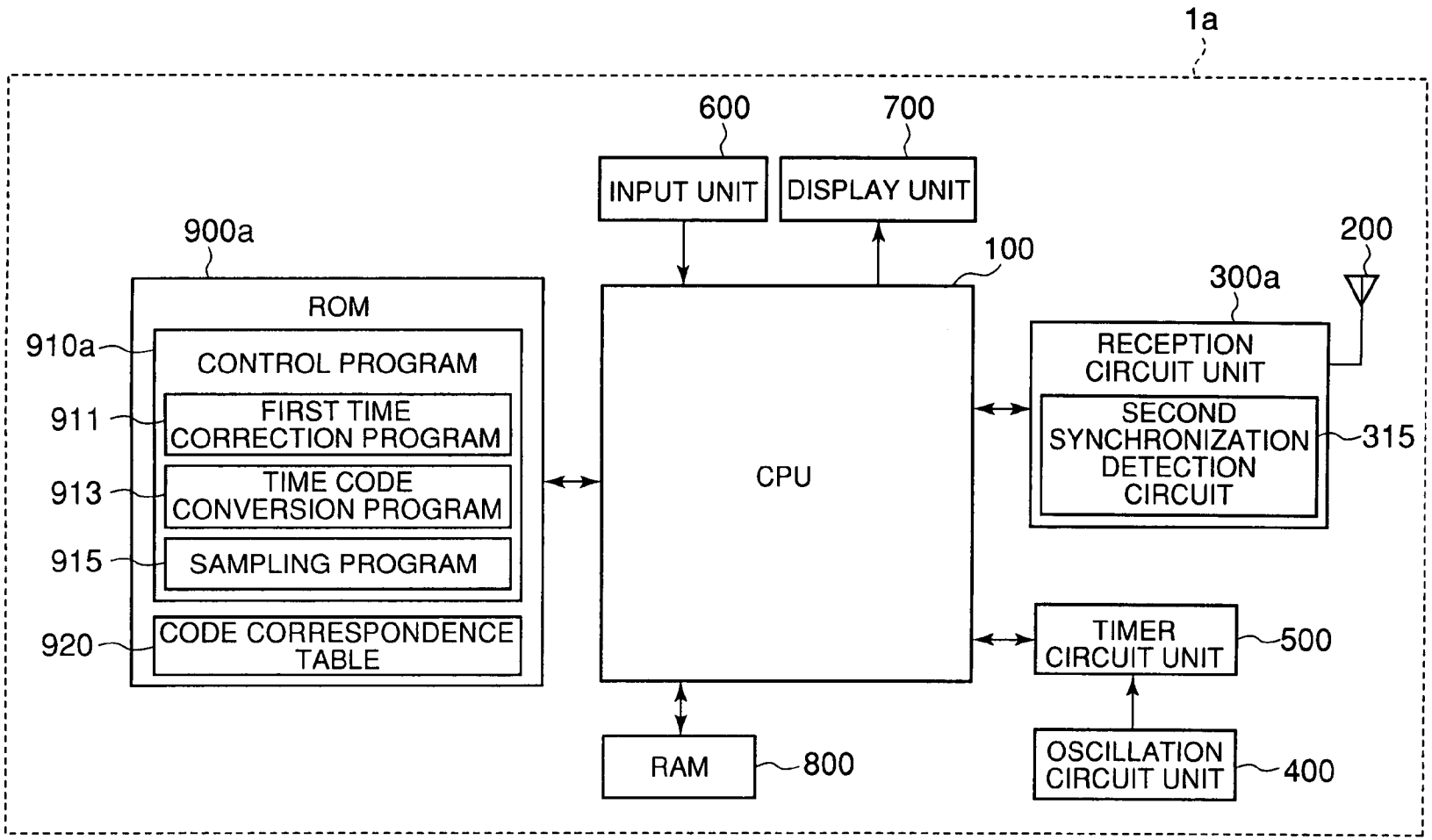
FIG. 1 is a block diagram showing an example of the functional configuration of a wave clock of a first embodiment.

FIG. 1 is a block diagram showing an example of the functional configuration of a wave clock 1*a* of the first embodiment. In the first embodiment, the wave clock la is composed of each functional unit of a CPU 100, a reception circuit unit 300*a*, an oscillation circuit unit 400, a timer circuit unit 500, an input unit 600, a display unit 700, a RAM 800 and a ROM 900*a*.

The CPU 100 reads a program stored in the ROM 900*a* according to predetermined timing, an operation signal input from the input unit 600, and the like, and expands the read program into the RAM 800. Then, the CPU 100 executes the processing based on the program to perform an instruction to each functional unit, the transfer of data, and the like. For example, the CPU 100 performs the control of outputting a switching signal for switching the frequency of a standard frequency broadcast to be received to a tuning switching circuit 301, which will be described later, to switch the reception frequency of an antenna 200, the processing of decoding a time code signal input from the reception circuit unit 300*a* to perform a time correction, and the like.

The reception circuit unit 300*a* cuts unnecessary frequency components of the standard frequency broadcast received by the antenna 200 to extract an aimed frequency signal. Then, the reception circuit unit 300*a* converts the extracted frequency signal into an electric signal to output the converted electric signal to the CPU 100.

Figure 2:
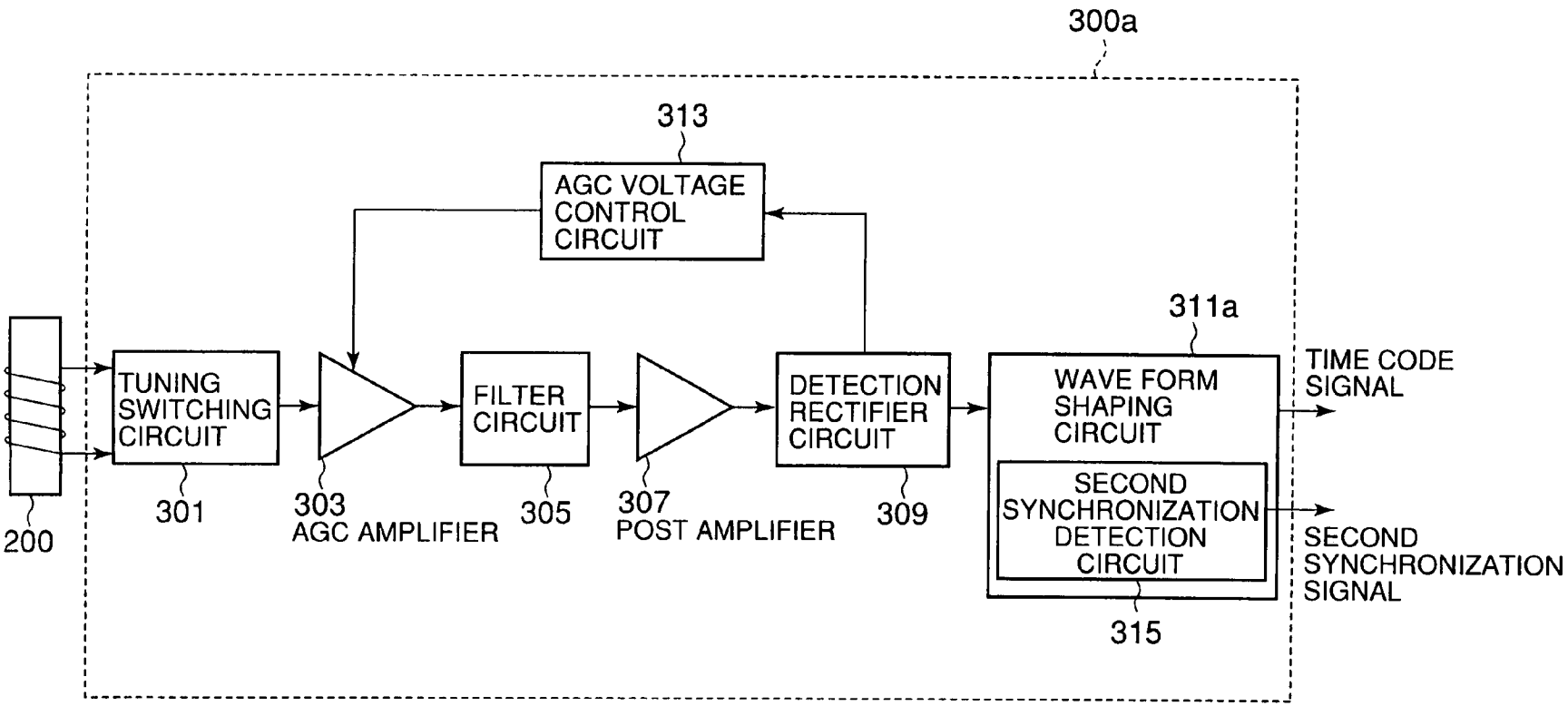
FIG. 2 is a block diagram showing an example of the configuration of a reception circuit unit in the first embodiment.

FIG. 2 is a block diagram showing an example of the configuration of the reception circuit unit 300*a* in the first embodiment. In the first embodiment, the reception circuit unit 300*a* is composed of the tuning switching circuit 301, an AGC amplifier 303, a filter circuit 305, a post amplifier 307, a detection rectifier circuit 309, a waveform shaping circuit 311*a* and an AGC voltage control circuit 313.

The tuning switching circuit 301 switches the reception frequency of the antenna 200 in accordance with a switching signal input from the CPU 100. For example, the antenna 200 is a bar antenna configured to be able to receive the standard frequency broadcast of each country such as a JJY standard frequency broadcast having a frequency of 40 kHz or 60 kHz (Japan), a WWVB standard frequency broadcast (United States) and a DCF77 standard frequency broadcast (Germany), and receives an electric wave signal having a reception frequency according to the control of the tuning switching circuit 301.

The AGC amplifier 303 amplifies or attenuates an electric wave signal (reception signal) input from the tuning switching circuit 301 according to a control signal input from the AGC voltage control circuit 313 to output the amplified or attenuated electric wave signal.

The filter circuit 305 is a band pass filter (BPF) having a very narrow passing band, and is made of a crystal filter for example. The filter circuit 305 outputs a signal input from the AGC amplifier 303 with a predetermined frequency range thereof being passed through the filter circuit 305 and the frequency components out of the range being intercepted.

The post amplifier 307 amplifies the signal input from the filter circuit 305 up to a predetermined signal level to output the amplified signal.

The detection rectifier circuit 309 detects the signal input from the post amplifier 307 to output the detected signal.

The waveform shaping circuit 311*a* compares the detection signal input from the detection rectifier circuit 309 with a predetermined threshold value to perform the waveform shaping of the compared detection signal into a binary value and to output the binary value. The time code signal (TCO) having been subjected to the waveform shaping by the waveform shaping circuit 311*a* and having been output is input into the CPU 100.

The AGC voltage control circuit 313 outputs a control signal for adjusting the amplification degree of the AGC amplifier 303 according to the level of the detection signal input from the detection rectifier circuit 309.

Moreover, the waveform shaping circuit 311*a* includes a second synchronization detection circuit 315. The second synchronization detection circuit 315 detects a second synchronization point indicating every positive second based on the time code signal input from the waveform shaping circuit 311*a*, and generates a second synchronization signal (synchronization signal) output every second in synchronization with the time interval of the data of the time code signal to output the generated second synchronization signal. The second synchronization signal output from the second synchronization detection circuit 315 is input into the CPU 100.

The description returns to FIG. 1. The oscillation circuit unit 400 includes a crystal oscillator, and always outputs a clock signal having a constant frequency.

The timer circuit unit 500 counts the clock signal input from the oscillation circuit unit 400 to time the present time, and outputs the present time data to the CPU 100.

The input unit 600 is composed of an operation switch for a user to input various operations, and the like. The input unit 600 outputs an operation signal according to the input with the operation switch or the like to the CPU 100.

The display unit 700 is a display apparatus composed of a small-sized liquid crystal display and the like, and displays the present time, the present reception frequency and the like based on a display signal input from the CPU 100.

The RAM 800 includes a memory region for temporarily holding various programs to be executed by the CPU 100, the data pertaining to the execution of the programs, and the like. The RAM 800 is used as a working area of the CPU 100.

The ROM 900*a* stores the programs, the data and the like for realizing various functions of the wave clock la as well as various initialization values and initialization programs. In particular, in order to realize the first embodiment, the ROM 900 stores a control program 910*a* including a first time correction program 911, a time code conversion program 913 and a sampling program 915; and a code correspondence table 920.

The first time correction program 911 is a program for, for example, controlling the antenna 200 and the reception circuit unit 300*a* every predetermined time to receive a standard frequency broadcast and to correct the present time timed by the timer circuit unit 50*b* based on the time code signal input from the reception circuit unit 300*a*, and for outputting a display signal based on the corrected present time to the display unit 700 to update a displayed time. The CPU 100 executes the first time correction processing in accordance with the first time correction program 911.

In the first time correction processing, the CPU 100 decodes the time code signal input from the reception circuit unit 300*a* to perform the time correction in accordance with a decoded result. At this time, the CPU 100 performs the processing according to the kind of the received standard frequency broadcast. In the following, the judgment methods of code data according to the classification of the standard frequency broadcasts are minutely described in order.

(1) JYY Standard Frequency Broadcast (40 kHz/60 kHz)

FIG. 3 is a diagram showing a time code system of a JJY standard frequency broadcast. As shown in FIG. 3, the time code of the JJY standard frequency broadcast is transmitted every minute by one frame of the time information having a format of 60 seconds of one period. Then, in the frame, the time information composed of a plurality of pieces of data divided every second is arranged as a time code signal expressed by binaries acquired by the comparison with a predetermined threshold value. That is, the second data the time intervals of which are expressed by the binaries divided every second is arranged as the time code.

Moreover, in the frame, the field indicating each data such as a top marker (M) for recognizing the start of the frame, position markers (P0-P5), minutes, hours, summing up days (the numbers of days from January first), years (lower two bits of the years of grace), days of the week, leap second information, spare bits and the like is coded to be arranged.

Figure 4A:
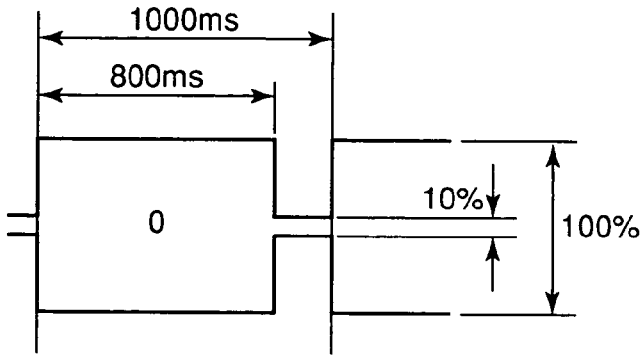
FIGS. 4A, 4B and 4C are diagrams for explaining the definition of pulse widths of the JJY standard frequency broadcast.
Figure 4B:
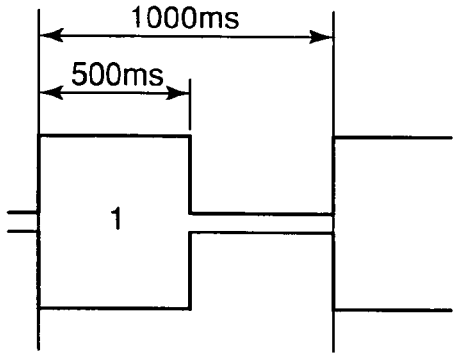
Figure 4C:
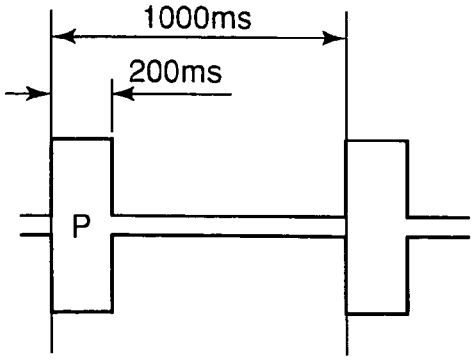

In more detail, any of the code data of "0", "1" and "P", which is the top marker or a position marker, is expressed by the pulse width of each of the data. FIGS. 4A, 4B and 4C are diagrams for explaining the definition of the pulse widths of the JJY standard frequency broadcast. That is, in the JJY standard frequency broadcast, time information is modulated to a carrier wave of 40 KHz or 60 KHz. When time information exists, the carrier wave is received to have the amplitude of 100%. When no time information exists, the carrier wave is received to have the amplitude of 10%.

Hereupon, a rise of a pulse wave is synchronized with the timing at every positive second (i.e. the second synchronization point). A pulse having the pulse width 800 (ms) shown in FIG. 4A corresponds to "0"; a pulse having the pulse width 500 (ms) shown in FIG. 4B corresponds to "1"; and a pulse having the pulse width of 200 (ms) shown in FIG. 4C corresponds to "P." Consequently, the interval of every positive second is a time interval expressing one piece of the code data indicating "0", "1" or "P."

For example, a second data signal corresponding to the code data "0" among the second data signals transmitted every second is defined to invert at a time of 800 ms from the starting point of the second data signal (see FIG. 4A). Moreover, a second data signal corresponding to the code data "1" is defined to invert at a time of 500 ms from the starting point of the second data signal (see FIG. 4B). That is, the probability of the existence of the inversions indicating "0" and "1", which are important code data, in the latter half of the second data signal is high, and the possibility that the inversions appearing in the first half thereof are noises is high. Moreover, a noise margin is few in the neighborhood of 800 ms from the starting point of the second data signal, and the signal is easily changed in the neighborhood of 800 ms.

When the JJY standard frequency broadcast is received, the last fall in each second period, i.e. the timing of the last change point, is judged to be the end of the pulse wave, and the time code signal is decoded. That is, the CPU 100 detects a change point at which the time code signal falls last in a second period, which is a period between second synchronization signals input from the second synchronization detection circuit 315. Alternatively, the CPU 100 calculates the time from the starting point of the second data to the change point at which the second data changes last in the period of the second data. That is, the CPU 100 calculates the time from the starting time of the second period to the last change point based on the change time point of the detected last change point. Then, the CPU 100 judges the code data indicated by the time code signal during the second period based on the calculated time.

Figure 5:
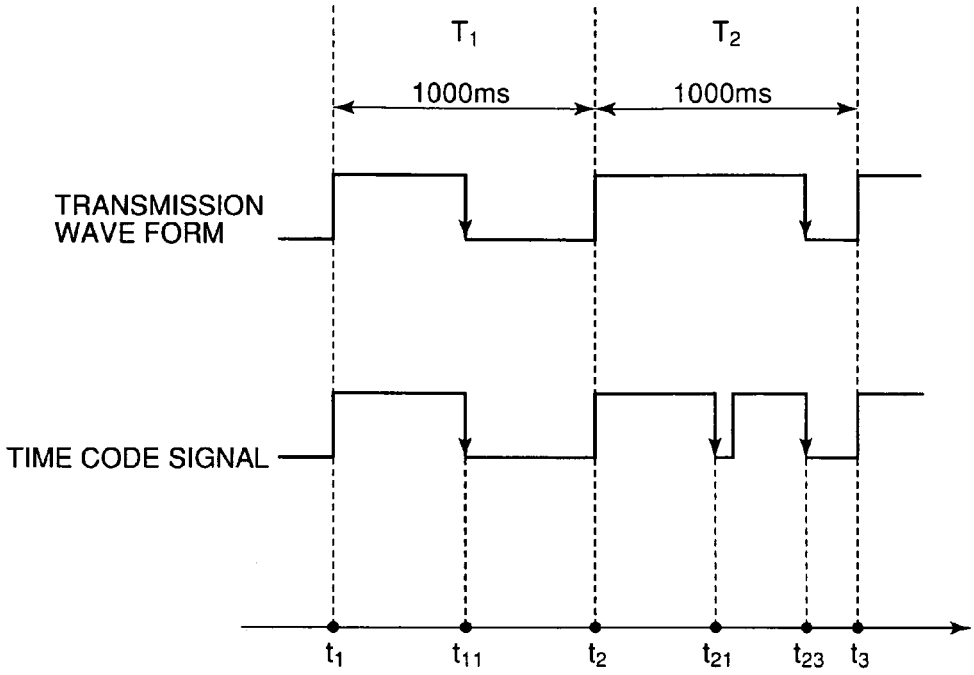
FIG. 5 is a diagram showing the examples of a transmission waveform of the JJY standard frequency broadcast and a time code signal having been subjected to waveform shaping.

The operation is concretely described with reference to FIG. 5. FIG. 5 is a diagram showing the examples of a transmission waveform of a JJY standard frequency broadcast and a time code signal which has been actually received by the antenna 200 and has been subjected to the waveform shaping by the reception circuit unit 300*a*. For example, when a second period T1 (t1-t2) is watched, a time point t11 at which the time code signal falls last in the second period T1 is detected, and the code data indicated by the time code signal in the second period T1 is judged based on the detected changed time point t11. On the other hand, in a second period T2 (t2-t3), the time code signal falls at time points t21 and t23, and the code data indicated by the time code signal in the second period T2 is judged based on the time point t23 at which the time code signal falls last.

Practically, the CPU 100 samples the time code signal at a predetermined sampling period (for example, 64 kHz), and detects a change point at which the time code signal changes last in a second period based on the sampling data generated as a result of the sampling processing to judge the code data.

Figure 6:
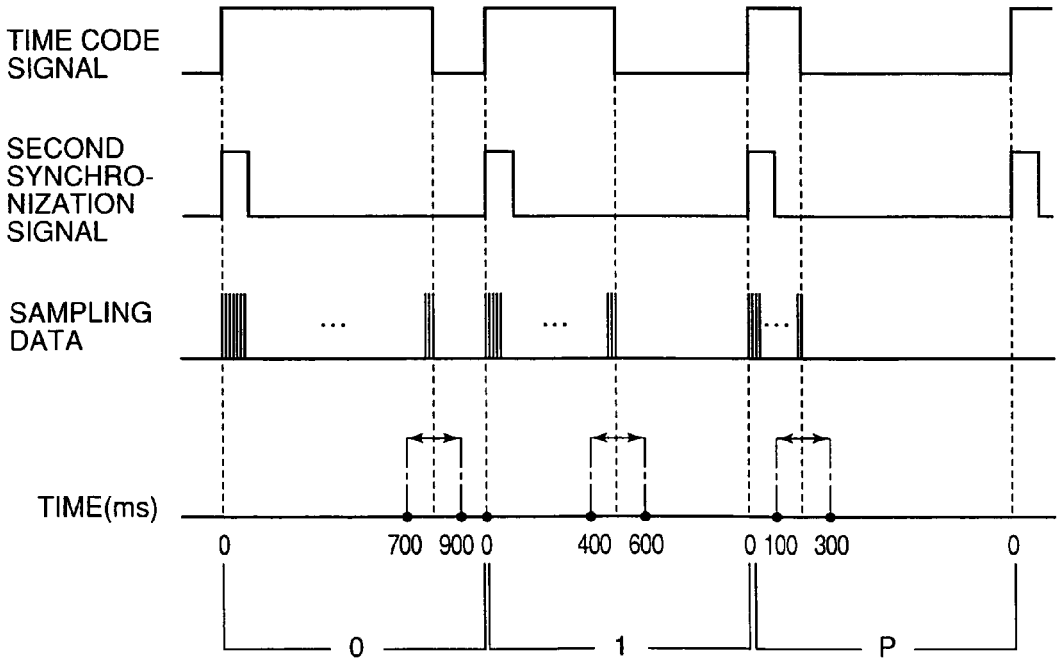
FIG. 6 is a diagram for explaining the judgment processing of code data at the time of the reception of the JJY standard frequency broadcast.

FIG. 6 is a diagram for explaining the judgment processing of a code data at the time of the reception of a JJY standard frequency broadcast. In the diagram, there are shown a time code signal input from the reception circuit unit 300*a*, a second synchronization signal input from the second synchronization detection circuit 315, and sampling data generated as a result of sampling processing.

As shown in FIG. 6, if a change time point of a change point at which the time code signal changes last is included in a range of, for example, from 700 (ms) to 900 (ms) when a second synchronization point as a starting point of the second synchronization signal is taken as the starting point, the code data indicated by the time code signal in the second period is judged to be "0."

Moreover, if the change time point of a change point at which the time code signal changes last is included in a range of, for example, from 400 (ms) to 600 (ms) when a second synchronization point is taken as the starting point, the code data indicated by the time code signal in the second period is judged to be "1."

Then, if the change time point of a change point at which the time code signal changes last is included in a range of, for example, from 100 (ms) to 300 (ms) when a second synchronization point is taken as the starting point, the code data indicated by the time code signal in the second period is judged to be "P."

(2) WWVB Standard Frequency Broadcast

FIG. 7 is a diagram showing a time code system of a WWVB standard frequency broadcast. As shown in FIG. 7, the time code of the WWVB standard frequency broadcast is transmitted every minute by one frame of the time information having a format of 60 seconds of one period similarly to the JJY standard frequency broadcast. Then, in the frame, the time information composed of a plurality of pieces of data divided every second is arranged as a time code signal expressed by binaries acquired by the comparison with a predetermined threshold value. That is, the second data the time intervals of which are expressed by the binaries divided every second is arranged as the time code.

Moreover, in the frame, the field indicating each data such as a top marker (M) for recognizing the start of the frame, position markers (P0-P5), minutes, hours, summing up days (the numbers of days from January first), years (lower two bits of the years of grace), days of the week, leap year information, leap second information, spare bits and the like is coded to be arranged.

Figure 8A:
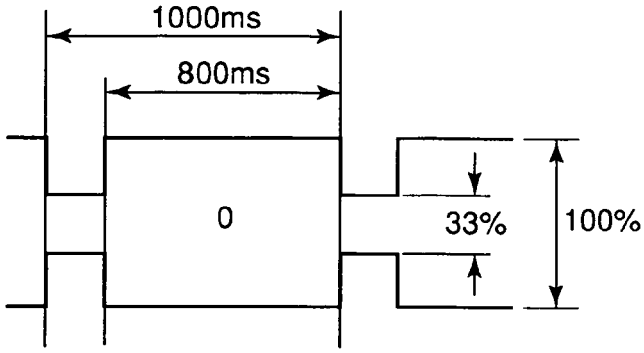
FIGS. 8A, 8B and 8C are diagrams for explaining the definition of pulse widths of the WWVB standard frequency broadcast.
Figure 8B:
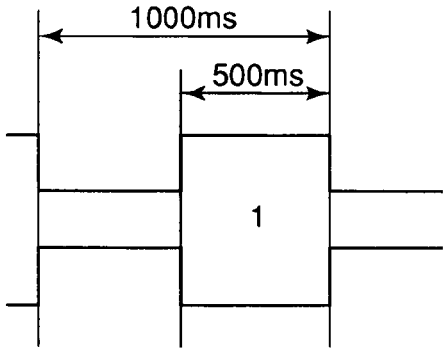
Figure 8C:
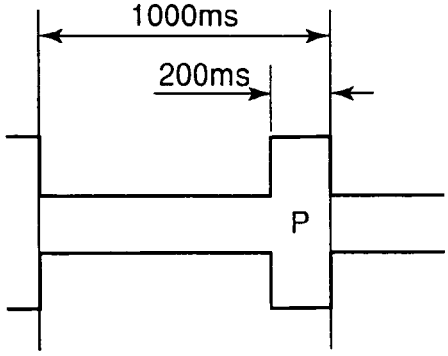

In more detail, any of the code data of "0", "1" and "P" is expressed by the pulse width of each of the data. FIGS. 8A, 8B and 8C are diagrams for explaining the definition of the pulse widths of the WWVB standard frequency broadcast. That is, in the WWVB standard frequency broadcast, time information is modulated to a carrier wave of 60 KHz. When time information exists, the carrier wave is received to have the amplitude of 100%. When no time information exists, the carrier wave is received to have the amplitude of 10%.

Hereupon, a fall of a pulse wave is synchronized with the timing at every positive second (i.e. the second synchronization point). A pulse having the pulse width 800 (ms) shown in FIG. 8A corresponds to "0"; a pulse having the pulse width 500 (ms) shown in FIG. 8B corresponds to "1"; and a pulse having the pulse width of 200 (ms) shown in FIG. 8C corresponds to "P."

For example, a second data signal corresponding to the code data "0" among the second data signals transmitted every second is defined to invert at a time of 200 ms from the starting point of the second data signal (see FIG. 8A). Moreover, a second data signal corresponding to the code data "1" is defined to invert at a time of 500 ms from the starting point of the second data signal (see FIG. 8B). That is, the probability of the existence of the inversions indicating "0" and "1", which are important code data, in the first half of the second data signal is high, and the possibility that the inversions appearing in the latter half are noises is high.

When the WWVB standard frequency broadcast is received, the first rise in each second period, i.e. the timing of the first change point, is judged to be the start of the pulse wave, and the time code signal is decoded. That is, the CPU 100 detects a change point at which the time code signal rises first in a second period, which is a period between second synchronization signals input from the second synchronization detection circuit 315. Alternatively, the CPU 100 calculates the time from the starting point of the second data to the change point at which the second data changes first in the period of the second data. That is, the CPU 100 calculates the time from the starting time of the second period to the change point based on the change time point of the detected first change point. Then, the CPU 100 judges the code data indicated by the time code signal during the second period based on the calculated time.

Practically, the CPU 100 performs sampling processing similarly to that in the case of the JJY standard frequency broadcast, and detects a change point at which the time code signal changes first in a second period based on the generated sampling data to judge the code data.

Figure 9:
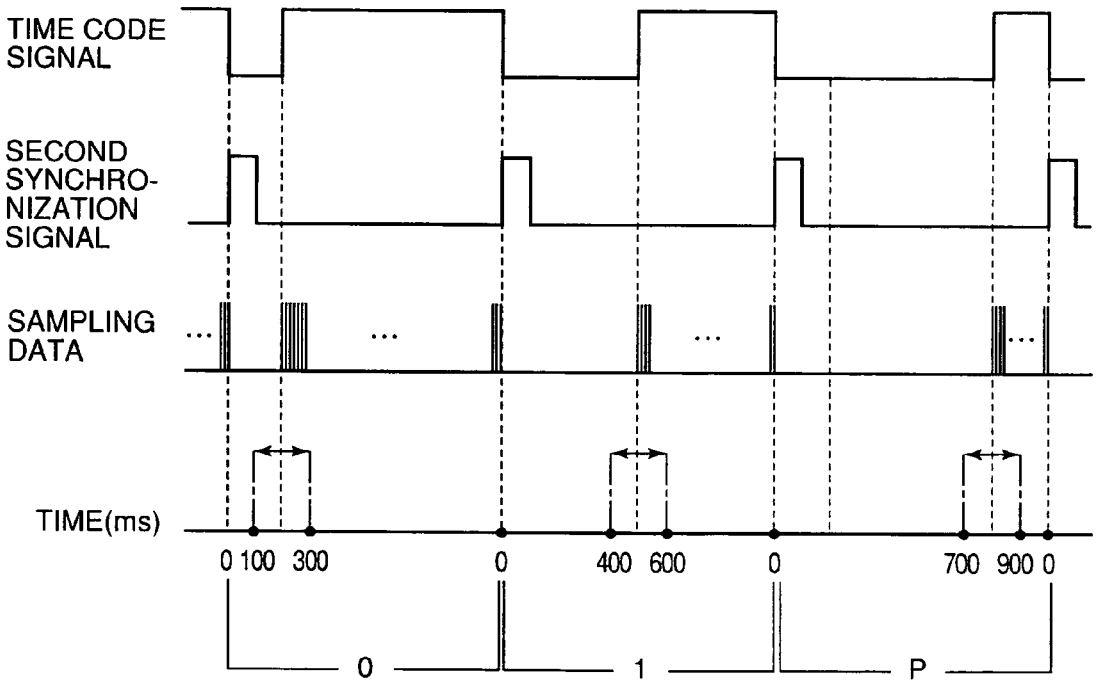
FIG. 9 is a diagram for explaining the judgment processing of code data at the time of the reception of the WWVB standard frequency broadcast.

FIG. 9 is a diagram for explaining the judgment processing of the code data at the time of the reception of a WWVB standard frequency broadcast. In the diagram, there are shown a time code signal input from the reception circuit unit 300*a*, a second synchronization signal input from the second synchronization detection circuit 315, and sampling data generated as a result of sampling processing.

As shown in FIG. 9, if a change time point of a change point at which the time code signal changes first is included in a range of, for example, from 100 (ms) to 300 (ms) when a second synchronization point as a starting point of the second synchronization signal is taken as the starting point, the code data indicated by the time code signal in the second period is judged to be "0."

Moreover, if the change time point of a change point at which the time code signal changes first is included in a range of, for example, from 400 (ms) to 600 (ms) when a second synchronization point is taken as the starting point, the code data indicated by the time code signal in the second period is judged to be "1."

Then, if the change time point of a change point at which the time code signal changes first is included in a range of, for example, from 700 (ms) to 900 (ms) when a second synchronization point is taken as the starting point, the code data indicated by the time code signal in the second period is judged to be "P."

(3) DCF77 Standard Frequency Broadcast

FIG. 10 is a diagram showing a time code system of a DCF77 standard frequency broadcast. As shown in FIG. 10, the time code of the DCF77 standard frequency broadcast is transmitted every minute by one frame of the time information having a format of 60 seconds of one period similarly to the JJY standard frequency broadcast. Then, in the frame, the time information composed of a plurality of pieces of data divided every second is arranged as a time code signal expressed by binaries acquired by the comparison with a predetermined threshold value. That is, the second data the time intervals of which are expressed by the binaries divided every second is arranged as the time code.

Moreover, in the frame, the field indicating each data such as a top marker (M) for recognizing the start of the frame, an antenna bit (R), leap second information, a start bit (S) of time information, minutes, hours, days, days of the week, months, years (lower two bits of the years of grace) and the like is coded to be arranged.

Figure 11A:
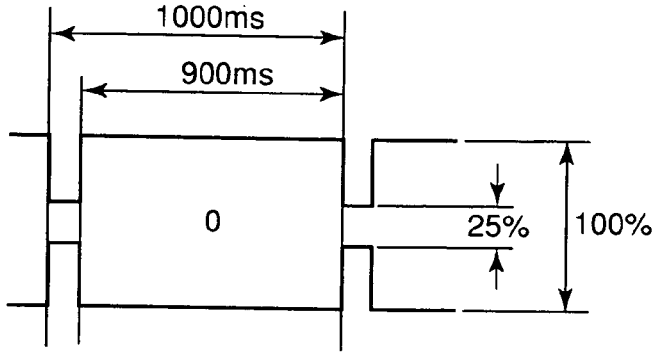
FIGS. 11A, 11B and 11C are diagrams for explaining the definition of pulse widths of the DCF77 standard frequency broadcast.
Figure 11B:
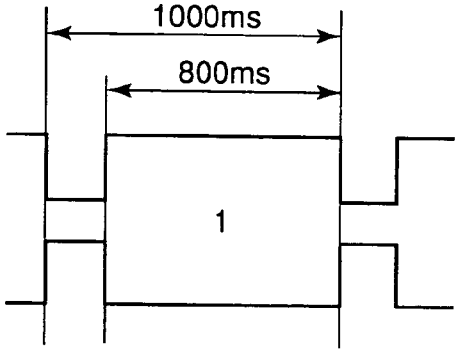
Figure 11C:
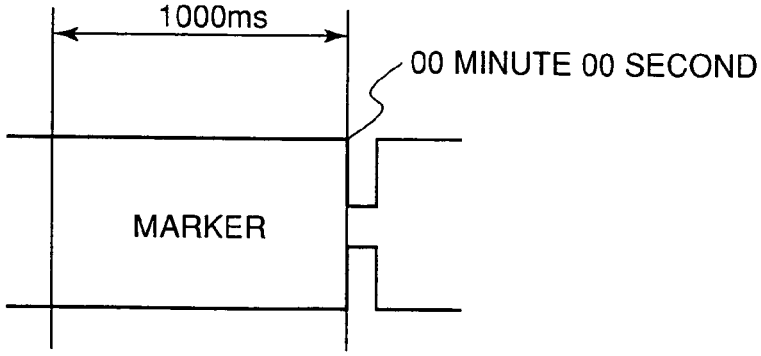

In more detail, any of the code data of "0", "1" and "marker" is expressed by the pulse width of each of the data. FIGS. 11A, 11B and 11C are diagrams for explaining the definition of the pulse widths of the DCF77 standard frequency broadcast. That is, in the DCF77 standard frequency broadcast, time information is modulated to a carrier wave of 77.5 KHz. When time information exists, the carrier wave is received to have the amplitude of 100%. When no time information exists, the carrier wave is received to have the amplitude of 10%.

Hereupon, a fall of a pulse wave is synchronized with the timing at every positive second (i.e. the second synchronization point). A pulse having the pulse width 900 (ms) shown in FIG. 11A corresponds to "0", and a pulse having the pulse width 800 (ms) shown in FIG. 11B corresponds to "1." Moreover, in the DCF77 standard frequency broadcast, a pulse that does not fall not to change in the timing of a positive second corresponds to the "marker."

For example, a second data signal corresponding to the code data "0" among the second data signals transmitted every second is defined to invert at a time of 100 ms from the starting point of the second data signal (see FIG. 11A). Moreover, a second data signal corresponding to the code data "1" is defined to invert at a time of 200 ms from the starting point of the second data signal (see FIG. 1B). That is, the probability of the existence of the inversions indicating "0" and "1", which are important code data, in the first half of the second data signal is high, and the possibility that the inversions appearing in the latter half are noises is high. Moreover, the possibility that the second data signal indicating the code data "1" is disturbed by noises after the code change thereof becomes high.

When the DCF77 standard frequency broadcast is received, the first rise in each second period, i.e. the timing of the first change point, is judged to be the start of the pulse wave, and the time code signal is decoded. That is, the CPU 100 detects a change point at which the time code signal rises first in a second period, which is a period between second synchronization signals input from the second synchronization detection circuit 315. Alternatively, the CPU 100 calculates the time from the starting point of the second data to the change point at which the second data changes first in the period of the second data. That is, the CPU 100 calculates the time from the starting time of the second period to the change point based on the change time point of the detected first change point. Then, the CPU 100 judges the code data indicated by the time code signal during the second period based on the calculated time.

Practically, the CPU 100 performs sampling processing similarly to that in the case of the JJY standard frequency broadcast, and detects a change point at which the time code signal changes first in a second period based on the generated sampling data to judge the code data.

Figures 12, 13:
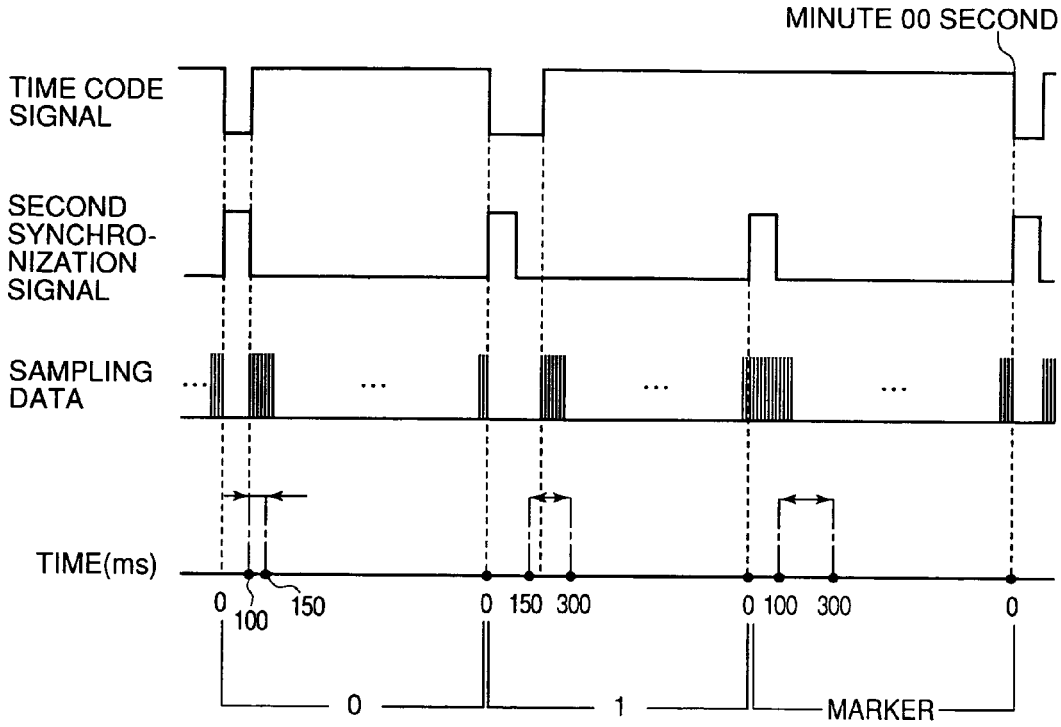
FIG. 12 is a diagram for explaining the judgment processing of code data at the time of the reception of the DCF77 standard frequency broadcast.
FIG. 13 is a diagram showing an example of the data configuration of a code correspondence table.

FIG. 12 is a diagram for explaining the judgment processing of the code data at the time of the reception of a DCF77 standard frequency broadcast. In the diagram, there are shown a time code signal input from the reception circuit unit 300*a*, a second synchronization signal input from the second synchronization detection circuit 315, and sampling data generated as a result of sampling processing.

As shown in FIG. 12, if a change time point of a change point at which the time code signal changes first is included in a range of, for example, from 100 (ms) to 150 (ms) when a second synchronization point as a starting point of the second synchronization signal is taken as the starting point, the code data indicated by the time code signal in the second period is judged to be "0."

Then, if the change time point of a change point at which the time code signal changes first is included in a range of, for example, from 150 (ms) to 300 (ms) when a second synchronization point is taken as the starting point, the code data indicated by the time code signal in the second period is judged to be "1."

Then, if no change points are detected in a range of, for example, from 100 (ms) to 300 (ms) when a second synchronization point is taken as the starting point, the code data indicated by the time code signal in the second period is judged to be the "marker."

The description returns to FIG. 1. The time code conversion program 913 is a program for controlling the reception circuit unit 300*a* to make the reception circuit unit 300*a* receive a standard frequency broadcast and perform the waveform shaping of the reception signal into a time code signal. The CPU 100 executes time code conversion processing in accordance with the time code conversion program 913.

The sampling program 915 is a program for sampling a time code signal input from the reception circuit unit 300*a* at a predetermined sampling period (for example, 64 kHz) to generate the sampling data thereof. The CPU 100 executes sampling processing in accordance with the sampling program 915.

The code correspondence table 920 is a data table defining a correspondence relation between the change time points of the change points and the code data of each of the standard frequency broadcast classification, and is referred to at the time of judging the code data. FIG. 13 is a diagram showing an example of the data configuration of the code correspondence table 920.

For example, when a JJY standard frequency broadcast of 40 kHz is received, code data is judged in accordance with the code correspondence table 920 as described above. That is, if the change time point of a detected change point is within the range of from 700 (ms) to 900 (ms) when a second synchronization point is taken as the starting point, the code data is judged to be "0"; if the change time point is within the range of from 400 (ms) to 600 (ms), the code data is judged to be "1"; and if the change time point is within the range of from 100 (ms) to 300 (ms), the code data is judged to be "P" (record L11).

When a JJY standard frequency broadcast of 60 kHz is received, code data is similarly judged. That is, if the change time point of a detected change point is within the range of from 700 (ms) to 900 (ms) when a second synchronization point is taken as the starting point, the code data is judged to be "0"; if the change time point is within the range of from 400 (ms) to 600 (ms), the code data is judged to be "1"; and if the change time point is within the range of from 100 (ms) to 300 (ms), the code data is judged to be "P" (record L13). In addition, if the change time point of a detected change point does not belong to any ranges, the detection is judged to be an error, for example.

On the other hand, when a WWVB standard frequency broadcast is received, code data is judged as follows. That is, if the change time point of a detected change point is within the range of from 100 (ms) to 300 (ms) when a second synchronization point is taken as the starting point, the code data is judged to be "0"; if the change time point is within the range of from 400 (ms) to 600 (ms), the code data is judged to be "1"; and if the change time point is within the range of from 700 (ms) to 900 (ms), the code data is judged to be "P" (record L15). In addition, if the change time point of a detected change point does not belong to any ranges, the detection is judged to be an error, for example.

Moreover, when a DCF77 standard frequency broadcast is received, code data is judged as follows. That is, if the change time point of a detected change point is within the range of from 100 (ms) to 150 (ms) when a second synchronization point is taken as the starting point, the code data is judged to be "0"; if the change time point is within the range of from 150 (ms) to 300 (ms), the code data is judged to be "1"; and if no change points are detected within the range of from 100 (ms) to 300 (ms), the code data is judged to be a "marker" (record L17). In addition, if the change time point of a detected change point does not belong to any ranges, the detection is judged to be an error, for example.

[Flow of Processing]

Figure 14:
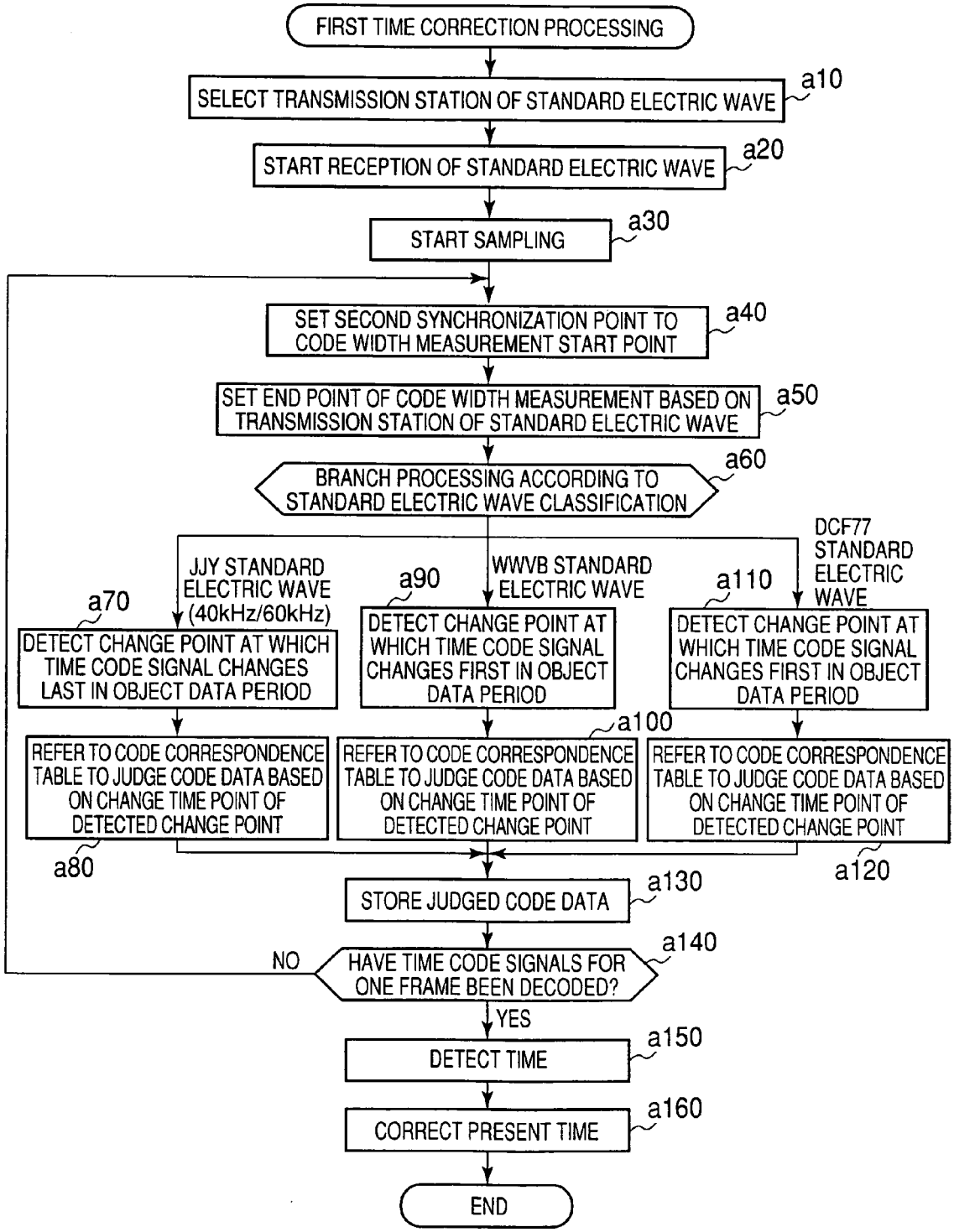
FIG. 14 is a flow chart for explaining the flow of first time correction processing.

Next, the flow of the first time correction processing is described. FIG. 14 is a flow chart for explaining the flow of the first time correction processing. In addition, the processing described here is the processing executed, for example, every predetermined time interval or in response to a reception starting operation of a standard frequency broadcast. The processing is realized by the operation of the CPU 100 to read the first time correction program 911 to execute it.

In the first time correction processing, the CPU 100 first selects a transmission station of the standard frequency broadcast in accordance with a user's operation (Step a10). At this time, the CPU 100 judges the standard frequency broadcast classification to be received in accordance with the selected transmission station.

Then, the CPU 100 reads the time code conversion program 913 to execute the time code conversion processing, and controls the reception circuit unit 300*a* to makes the reception circuit unit 300*a* start the reception of the standard frequency broadcast (Step a20). Moreover, the CPU 100 reads the sampling program 915 to execute sampling processing, and starts the sampling of a time code signal input from the reception circuit unit 300*a* (Step a30).

Successively, the CPU 100 sets the input timing of the second synchronization signal from the second synchronization detection circuit 315 to a code width measurement start point (Step a40), and sets a code width measurement end point according to the standard frequency broadcast classification to be received (Step a50).

The CPU 100 appropriately sets the code width measurement end point. For example, if the JJY standard frequency broadcast or the WWVB standard frequency broadcast is received, the CPU 100 sets the timing of 900 (ms) from the code width measurement start point as the code width measurement end point, and if the DCF77 standard frequency broadcast is received, the CPU 100 sets the timing of 300 (ms) from the code width measurement start point as the code width measurement end point. In addition, although a description is based on the supposition that a part of the period of a second period is set as an object data period in accordance with the code width measurement end point set here to detect a change point in the following, it is a matter of course that the input timing of the next second synchronization signal may be set as the code width measurement end point to use the whole period of the second period as the object data period for detecting the change point.

Successively, the CPU 100 branches the processing according to the received standard frequency broadcast classification (Step a60).

That is, when the received standard frequency broadcast classification is the JJY standard frequency broadcast of 40 kHz or the JJY standard frequency broadcast of 60 kHz, the CPU 100 detects a change point at which a time code signal changes last in the object data period, which is a period between the code width measurement start point set at the Step a40 and the code width measurement end point set at the Step a50 based on the sampling data generated as a result of the sampling processing started at the Step a30 (Step a70). Then, the CPU 100 refers to the record for the JJY standard frequency broadcast in the code correspondence table 920 to judge the code data based on the change time point of a detected change point (Step a80).

When the received standard frequency broadcast classification is the WWVB standard frequency broadcast, the CPU 100 detects a change point at which the time code signal changes first in the object data period based on the sampling data generated as a result of the sampling processing started at the Step a30 (Step a90). Then, the CPU 100 refers to the record for the WWVB standard frequency broadcast in the code correspondence table 920 to judge the code data based on the change time point of a detected change point (Step a100).

When the received standard frequency broadcast classification is the DCF77 standard frequency broadcast, the CPU 100 detects a change point at which the time code signal changes first in the object data period based on the sampling data generated as a result of the sampling processing started at Step a30 (Step a110). Then, the CPU 100 refers to the record for the DCF77 standard frequency broadcast in the code correspondence table 920 to judge the code data based on the change time point of a detected change point (Step a120).

Then, the CPU 100 makes the RAM 800 temporarily store the code data judged at the Step a80, the Step a100 or the Step a120 (Step a130).

Then, the CPU 100 repeats the processing at the Steps a40-a130. When the CPU 100 has decoded the time code signal for one frame (Step a140: YES), the CPU 100 extracts the time according to the decoded result (Step a150), and corrects the present time timed by the timer circuit unit 500 (Step a160)

As described above, according to the first embodiment, when the JJY standard frequency broadcast of 40 kHz or 60 kHz is received, a change point at which the time code signal falls last in a second period, which is a period between the second synchronization signals input from the second synchronization detection circuit 315, i.e. the last change point, is detected, and the code data indicated by the time code signal in the second period can be judged based on the change time point of the detected last change point. Moreover, when the WWVB standard frequency broadcast or the DCF77 standard frequency broadcast is received, a change point at which the time code signal rises first in a second period, i.e. the first change point, is detected, and the code data indicated by the time code signal in the second period can be judged based on the change time point of the detected first change point.

In such a way, the demodulation of a standard frequency broadcast to be received can be performed by selecting a change time point at which data is included in consideration of the nature of the data format and the transfer characteristic of the standard frequency broadcast.

Consequently, even if noise components are intermixed with a reception signal, the time code signal can be pertinently decoded. Consequently, the false detection of time information can be prevented to improve reception performance.

In addition, when a plurality of changes of a time code signal is detected in each second period, to put it concretely, when a plurality of falls of the time code signal is detected in each second period in the case of receiving a JJY standard frequency broadcast of 40 kHz or 60 kHz, or when a plurality of rises of the time code signal is detected in each second period in the case of receiving a WWVB standard frequency broadcast or a DCF77 standard frequency broadcast, the reception state may be judged to be bad, and a warning display may be performed on the display unit 700.

Moreover, in the first embodiment mentioned above, when a JJY standard frequency broadcast of 40 kHz or 60 kHz is received, a time code signal is decoded based on a change time point at which the time code signal falls last in each second period. Moreover, when a WWVB standard frequency broadcast or a DCF77 standard frequency broadcast is received, a time code signal is decoded based on a change time point at which the time code signal rises first in each second period. However, a time code signal may be decoded as follows.

That is, the existence of a change of each of a plurality of predetermined sections in a second period among the changes of a time code signal may be detected to decode the time code signal based on a change pattern of the existence of the change of each section.

To put it concretely, when a JJY standard frequency broadcast of 40 kHz or 60 kHz is received, a time code signal is decoded based on the existence of a fall of the time code signal in each section. When a WWVB standard frequency broadcast or a DCF77 standard frequency broadcast is received, a time code signal is decoded based on the existence of a rise of the time code signal in each section. In this case, for example, the data configuration of the code correspondence table 920 is changed to the data configuration described in the following.

FIG. 15A is a diagram showing a modified example of the data configuration of the code correspondence table for the JJY standard frequency broadcast, in which correspondence relations between a change pattern defining the existence of a change of a time code signal in each section of from 100 (ms) to 300 (ms), from 400 (ms) to 600 (ms) and from 700 (ms) to 900 (ms) and code data.

For example, according to the code correspondence table shown in FIG. 15A, when no falls of a time code signal are detected in the ranges of from 100 (ms) to 300 (ms) and from 700 (ms) to 900 (ms) from a second synchronization point used as the starting point and a fall of the time code signal is detected in the range of from 400 (ms) to 600 (ms) from the second synchronization point used as the starting point, the change pattern is regarded as one shown in a record L21, and the code data is judged to be "1".

Moreover, when no falls of a time code signal are detected in the range of from 700 (ms) to 900 (ms) from the second synchronization point used as the starting point and a fall of the time code signal is detected in the ranges of from 100 (ms) to 300 (ms) and from 400 (ms) to 600 (ms), the change pattern is regarded as one shown in a record L22, and the code data is judged to be "1" also in this case.

Moreover, FIG. 15B is a diagram showing another modified example of the code correspondence table for the JJY standard frequency broadcast. The correspondence relations between change patterns defining the existence of changes of a time code signal and code data may be set as the diagram.

For example, when a fall of the time code signal is detected in each of the ranges of from 100 (ms) to 300 (ms), from 400 (ms) to 600 (ms) and from 700 (ms) to 900 (ms) from a second synchronization point used as the starting point, the code data is judged to be "0" according to the code correspondence table shown in FIG. 15A. On the other hand, the change pattern is judged to be an error according to the code correspondence table shown in FIG. 15B.

In such a way, code data may be judged based on the previous setting of change patterns to decode a time code signal.

Moreover, FIG. 16A is a diagram showing a modified example of the data configuration of the code correspondence table for the WWVB standard frequency broadcast, in which correspondence relations between a change pattern defining the existence of a change of a time code signal in each section of from 100 (ms) to 300 (ms), from 400 (ms) to 600 (ms) and from 700 (ms) to 900 (ms) and code data are set.

Moreover, FIG. 16B is a diagram showing another example of the code correspondence table for the WWVB standard frequency broadcast. The correspondence relations between change patterns defining the existence of changes of a time code signal and code data may be set as the diagram.

For example, when no falls of the time code signal are not detected in the range of from 400 (ms) to 600 (ms) from a second synchronization point used as the starting point and a fall of the time code signal is detected in each of the ranges of from 100 (ms) to 300 (ms) and from 700 (ms) to 900 (ms) from the second synchronization point used as the starting point, the code data is judged to be "P" (record L25) according to the code correspondence table shown in FIG. 16A. On the other hand, the code data is judged to be "0" (record L26) according to the code correspondence table shown in FIG. 16B.

Moreover, FIG. 17 is a diagram showing a modified example of the data configuration of a code correspondence table for the DCF77 standard frequency broadcast, in which correspondence relations between a change pattern defining the existence of a change of a time code signal in each section of from 100 (ms) to 300 (ms) and from 150 (ms) to 300 (ms) are set.

Second Embodiment

Next, a second embodiment is described. In addition, the parts similar to those of the first embodiment are denoted by the same reference numerals as those of the first embodiment and their descriptions are omitted.

[Functional Configuration]

Figure 18:
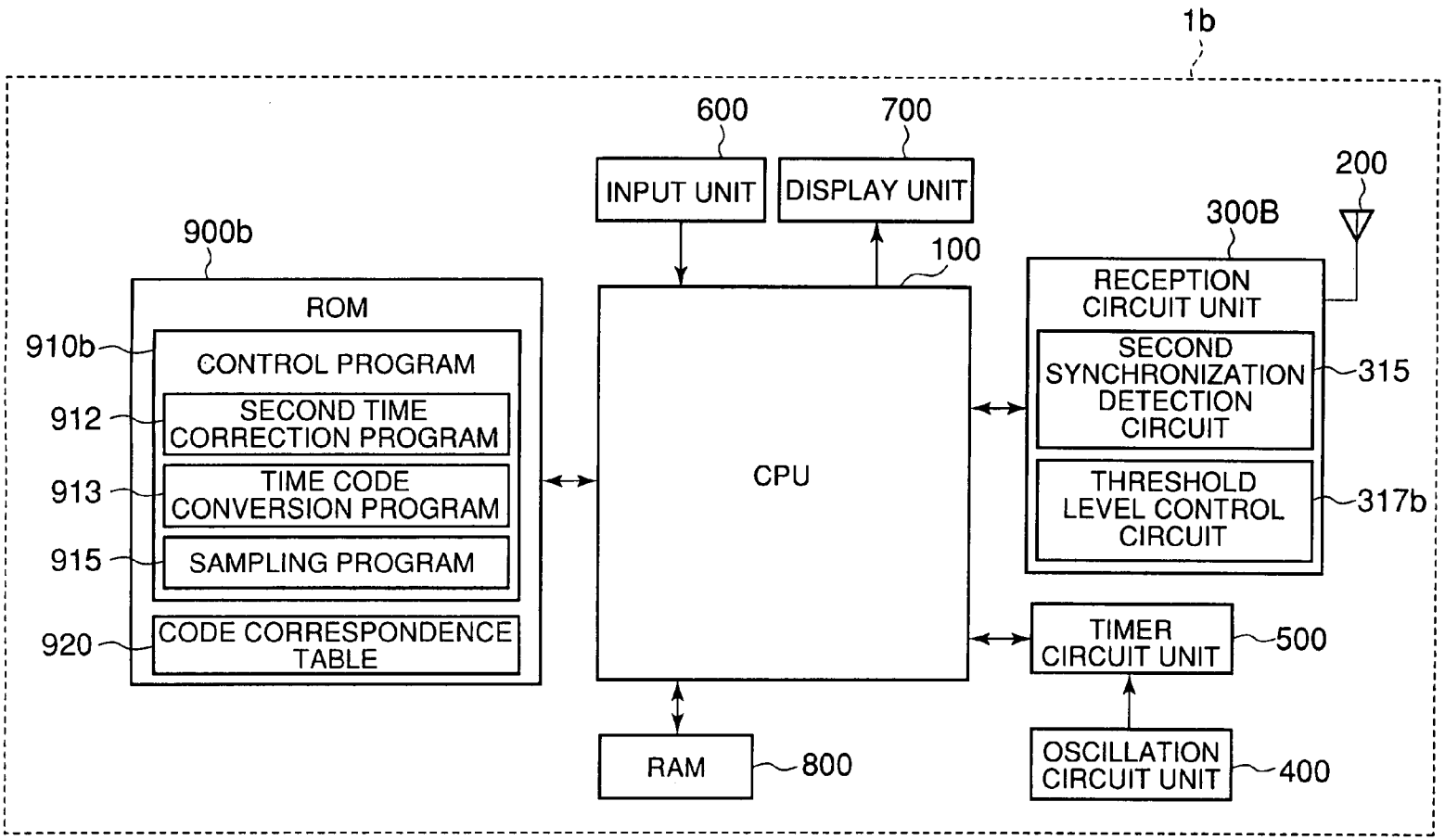
FIG. 18 is a block diagram showing an example of the functional configuration of a wave clock of a second embodiment.

FIG. 18 is a block diagram showing an example of the functional configuration of a wave clock 1*b* of the second embodiment. In the second embodiment, the wave clock 1*b* is composed of each functional unit of the CPU 100, a reception circuit unit 300*b*, the oscillation circuit unit 400, the timer circuit unit 500, the input unit 600, the display unit 700, the RAM 800 and a ROM 900*b*.

Figure 19:
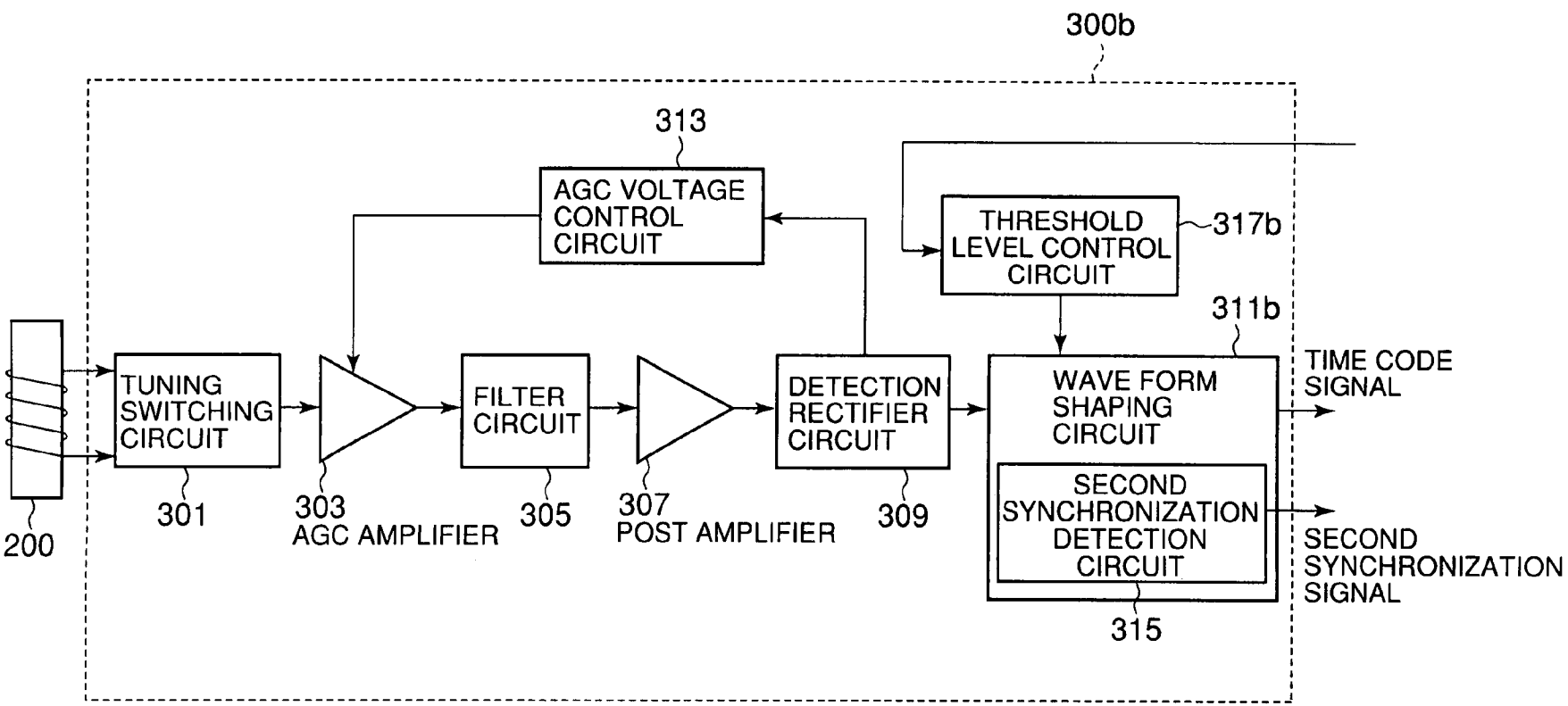
FIG. 19 is a block diagram showing an example of the configuration of a reception circuit unit in the second embodiment.

In the second embodiment, the reception circuit unit 300*b* is equipped with a threshold level control circuit 317*b* in addition to the configuration of the reception circuit unit 300*a* of the first embodiment. FIG. 19 is a block diagram showing an example of the configuration of the reception circuit unit 300*b* of the second embodiment. That is, the reception circuit unit 300*b* is composed of the tuning switching circuit 301, the AGC amplifier 303, the filter circuit 305, the post amplifier 307, the detection rectifier circuit 309, a waveform shaping circuit 311*b*, the AGC voltage control circuit 313, the second synchronization detection circuit 315 and the threshold level control circuit 317*b*.

The threshold level control circuit 317*b* outputs a control signal for adjusting a predetermined threshold value (threshold level) based on the identification information of a standard frequency broadcast classification input from the CPU 100 (i.e. a transmission station of a standard frequency broadcast to be received). The control signal output from the threshold level control circuit 317*b* is input into the waveform shaping circuit 311*b*.

Then, the waveform shaping circuit 311*b* performs the waveform shaping of a detection signal input from the detection rectifier circuit 309 to a time code signal. To put it concretely, the waveform shaping circuit 311*b* compares the detection signal with the threshold level adjusted by the threshold level control circuit 317*b* to generate a time code signal composed of binary values.

Figure 20A:
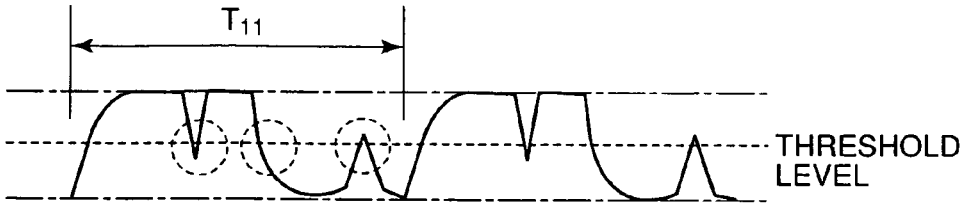
FIGS. 20A and 20B are diagrams showing an example of a detected detection signal.
Figure 20B:
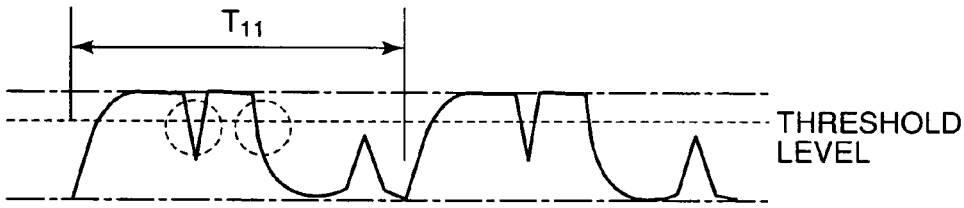

The operation of the waveform shaping circuit 311*b* is concretely described with reference to FIGS. 20A and 20B. FIGS. 20A and 20B are diagrams showing a detection signal which has been received by the antenna 200 and has been detected by the detection rectifier circuit 309. For example, when the threshold level is set at the center of the amplitude of the detection signal as shown in FIG. 20A, three times of fall changes are detected in the second period T11. On the other hand, when the threshold level is set at a value rather higher than the threshold level mentioned above as shown in FIG. 20B, two times of falls are detected in the second period T11. In the second embodiment, the threshold level to be used at the time of performing the waveform shaping of a detection signal is adjusted according to the transmission station which has transmitted the standard frequency broadcast (to put it concretely, the kind of the received standard frequency broadcast, namely a standard frequency broadcast classification).

Now, a low pass filter for noise elimination is generally provided at the output stage of the detection rectifier circuit 309. When a DCF77 standard frequency broadcast is received, the time constant of the low pass filter is ordinarily small. On the other hand, when a JJY standard frequency broadcast or a WWVB standard frequency broadcast is received, the time constant of the low pass filter is large.

Figure 21:
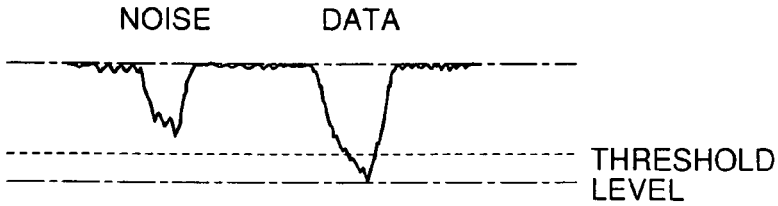
FIG. 21 is a diagram showing an output waveform from a detection rectifier circuit in the case of the reception of a DCF77 standard frequency broadcast.

FIG. 21 is a diagram showing an output waveform of the detection rectifier circuit 309 at the time of the reception of a DCF77 standard frequency broadcast. As described above, when the DCF77 standard frequency broadcast is received, the low pass filter provided at the output stage of the detection rectifier circuit 309 has a small time constant. Consequently, the output waveform of the detection rectifier circuit 309 includes high frequency noises. In the example shown in FIG. 21, saw tooth wave-like pulse noises appear in addition to the high frequency noises. In this case, it is possible to lessen the influence of the pulse noises at the time of binarization by lowering the threshold level.

Figure 22:
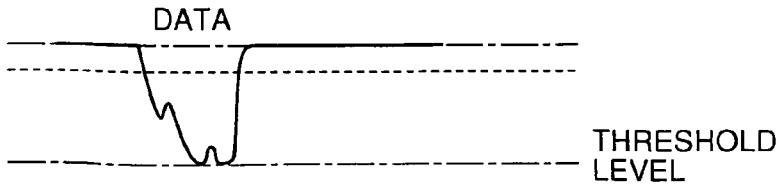
FIG. 22 is a diagram showing an output waveform from the detection rectifier circuit in the case of the reception of a WWVB standard frequency broadcast.

FIG. 22 is a diagram showing an output waveform of the detection rectifier circuit 309 at the time of the reception of a WWVB standard frequency broadcast. When the WWVB standard frequency broadcast is received, the low pass filter provided at the output stage of the detection rectifier circuit 309 is set to have a large time constant not so as to include harmonic noises on an output waveform. However, noises included in data waveform itself cannot be removed and the noises are superimposed on the data waveform as shown in FIG. 22. In such a case, the influence of the noises at the time of binarization can be lessened by setting the threshold level high, and only data can be extracted. The situation is also true at the time of receiving a JJY standard frequency broadcast.

FIG. 23 is a diagram showing an adjustment example of the threshold level. The threshold level control circuit 317*b* stores a data table in which correspondence relations between the standard frequency broadcast classifications (i.e. transmission stations to transmit standard frequency broadcasts to be received) and the values of threshold levels shown in FIG. 23 are defined, and refers to the data table to select the value of the threshold level corresponding to the transmission station of the standard frequency broadcast to be received. Then, the threshold level control circuit 317*b* outputs a control signal to set the selected value as the threshold level to the waveform shaping circuit 311*b*.

For example, when a JJY standard frequency broadcast of 40 KHz is received, the threshold level control circuit 317*b* outputs a control signal to set a predetermined standard value as the threshold level to the waveform shaping circuit 311*b* (record L31).

When a WWVB standard frequency broadcast is received, the threshold level control circuit 317*b* sets a value rather higher than the standard value mentioned above as the threshold level. For example, the threshold level control circuit 317*b* outputs a control signal to set the threshold value to a value being 1.1 times as large as the standard value to the waveform shaping circuit 311*b* (record L33).

When a DCF77 standard frequency broadcast is received, the threshold level control circuit 317*b* sets a value rather lower than the standard value as the threshold level. For example, the threshold level control circuit 317*b* outputs a control signal to set the threshold value to a value being 0.9 times as large as the standard value to the waveform shaping circuit 311*b* (record L35).

The description is returned to FIG. 18 again. For realizing the second embodiment, the ROM 900*b* of the wave clock 1*b* stores a control program 910*b* including a second time correction program 912, the time code conversion program 913 and the sampling program 915; and the code correspondence table 920.

The second time correction program 912 is a program for, for example, controlling the antenna 200 and the reception circuit unit 300*b* every predetermined time to receive a standard frequency broadcast and to correct the present time timed by the timer circuit unit 500 based on the time code signal input from the reception circuit unit 300*b*, and for outputting a display signal based on the corrected present time to the display unit 700 to update a displayed time. The CPU 100 executes the second time correction processing in accordance with the second time correction program 912.

In the second time correction processing, the CPU 100 outputs the identification information of the standard frequency broadcast classification to be received to the threshold level control circuit 371*b* to make the threshold level control circuit 317*b* adjust a threshold level.

[Flow of Processing]

Figure 24:
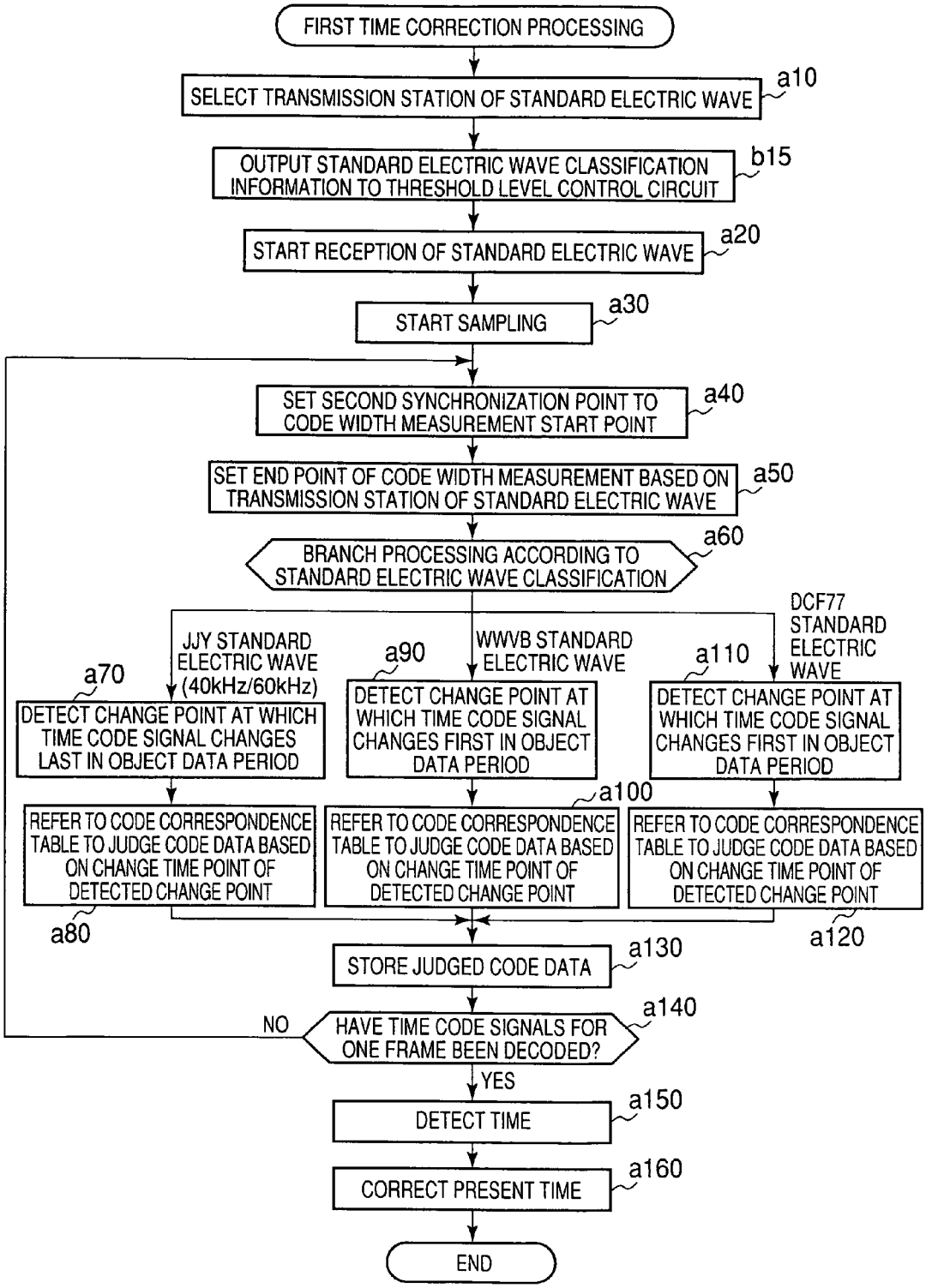
FIG. 24 is a flow chart for explaining the flow of second time correction processing.

Next, the flow of the second time correction processing is described. FIG. 24 is a flow chart for explaining the flow of the second time correction processing. In addition, the processing described here is the processing executed, for example, every predetermined time interval or in response to a reception starting operation of a standard frequency broadcast. The processing is realized by the operation of the CPU 100 to read the second time correction program 911 to execute it.

In the second time correction processing, the CPU 100 selects a transmission station of a standard frequency broadcast at the Step a10, and the CPU 100 judges the standard frequency broadcast classification to be received in accordance with the selected transmission station. After that, the CPU 100 outputs the identification information of the standard frequency broadcast classification to the threshold level control circuit 317*b* (Step b15). Then, the CPU 100 shifts the processing thereof to that at the Step a20, which has been described with regard to the first embodiment. After that, the CPU 100 performs the processing similar to that of the first embodiment.

As described above, according to the second embodiment, because it is possible to adjust the threshold level used at the time of the waveform shaping of a detection signal in order to make it possible to perform the most accurate binarization of the detection signal according to the classification (transmission station) of the standard frequency broadcast to be received in consideration of the property of the data format and the transfer characteristic of the standard frequency broadcast, it becomes possible to prevent the false detection of time information to improve the reception performance of the wave clock.

In addition, although a predetermined standard value is set as a reference value to perform the adjustment of the threshold level corresponding to a standard frequency broadcast classification to be received in the second embodiment mentioned above, the adjustment of the threshold level may be performed as follows.

That is, for example, the threshold level may be controlled correspondingly to the detection method of a change point at the time of decoding a time code. In this case, the CPU 100 performs the processing of outputting the information pertaining to the detection method of a change point at the time of decoding the time code to the threshold level control circuit 317*b* in place of the processing at the Step b15 in FIG. 24.

FIG. 25 is a diagram showing adjustment examples of the threshold level in this case.

For example, when a time code is decoded by detecting a change point at which a time code signal changes last in a second period, namely when a JJY standard frequency broadcast of 40 kHz or 60 kHz is received, the threshold level control circuit 317*b* sets the threshold level to a value rather higher than a predetermined standard value, and outputs a control signal to set the threshold level to a value, for example, being 1.1 times as large as the standard value to the waveform shaping circuit 311*b* (record L41).

A JJY standard frequency broadcast has long time intervals indicating the code data expressing "0" and "1" as shown in FIGS. 4A and 4B. In this case, when noises are superimposed on the parts of the code data other than the time interval indicating the data, the superimposed noises can avoid being binarized if the threshold level is set to be rather higher as shown in FIG. 20B.

Moreover, when a time code is decoded by detecting a change point at which a time code signal changes first in a second period, namely in the case of receiving a WWVB standard frequency broadcast or a DCF77 standard frequency broadcast, the threshold level control circuit 317*b* sets the threshold level to be a value rather lower than the standard value mentioned above, and outputs a control signal to set the threshold level to a value, for example, being 0.9 times as large as the standard value to the waveform shaping circuit 311*b* (record L43).

A WWVB standard frequency broadcast and a DCF77 standard frequency broadcast severally have short time intervals indicating the code data expressing "0" and "1." In this case, there is a possibility that a pulse expressing data takes a saw tooth wave shape. If the pulse takes such a waveform, it is possible to binarize a detection signal more accurately by setting the threshold level to be rather lower than the standard value.

Figure 26:
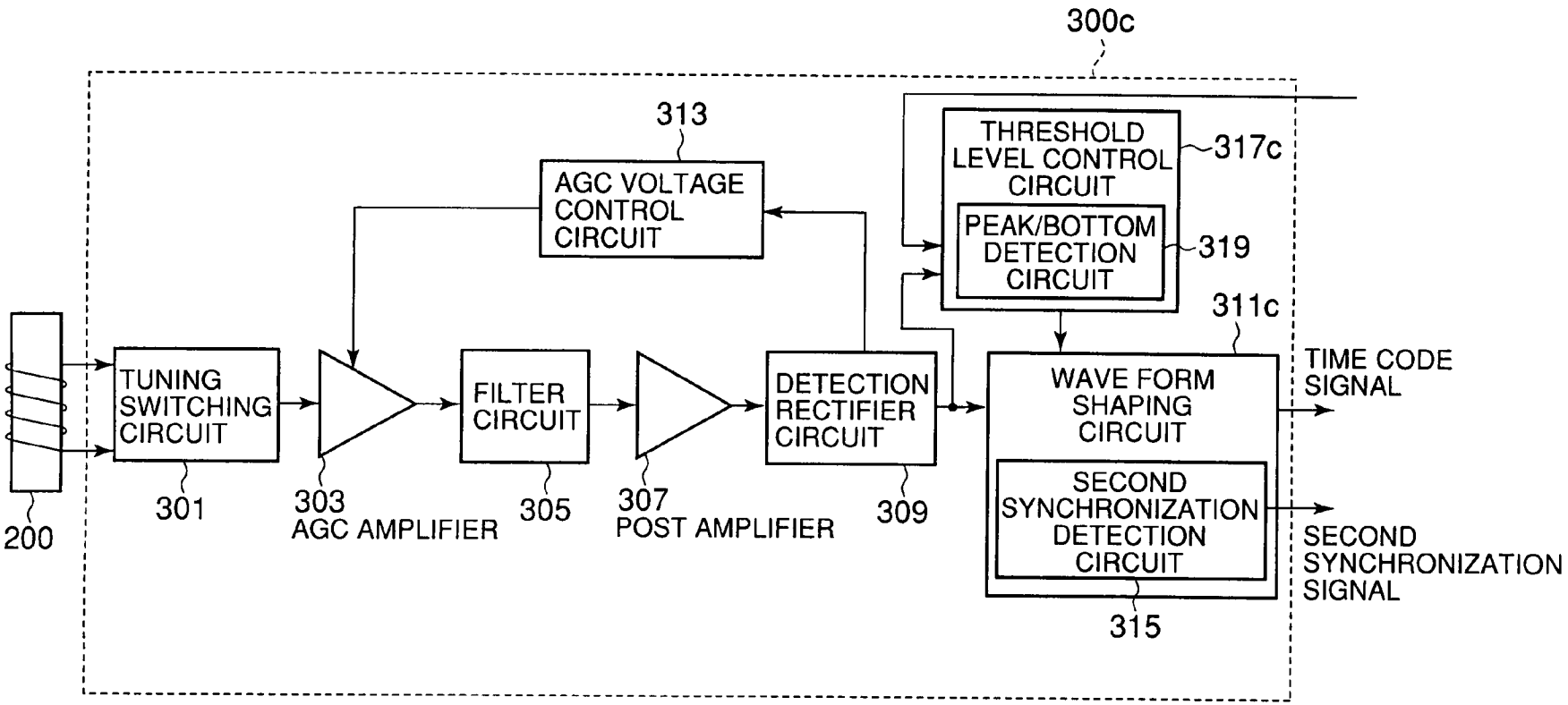
FIG. 26 is a block diagram showing a modified example of the configuration of a reception circuit unit.

Moreover, the threshold level may be controlled according to the peak value and the bottom value of a detection signal. FIG. 26 is a block diagram showing the configuration of a reception circuit unit 300*c* of the present modified example. In the present modified-example, the reception circuit unit 300*c* is provided with a threshold level control circuit 317*c* equipped with a peak/bottom detection circuit 319 in place of the threshold level control circuit 317*b* of the second embodiment.

The peak/bottom detection circuit 319 detects the peak value and the bottom value of a detection signal input from the detection rectifier circuit 309. Then, the threshold level control circuit 317*c* outputs a control signal to adjust the threshold level based on the peak value and the bottom value of a detection signal detected by the peak/bottom detection circuit 319 to a waveform shaping circuit 311*c*.

FIG. 27 is a diagram showing adjustment examples of the threshold level in this case.

For example, in the case of receiving a JJY standard frequency broadcast, the threshold level control circuit 317*c* outputs a control signal to set the threshold level to an intermediate value of the peak value and the bottom value of a detection signal having been detected by the peak/bottom detection circuit 319 to the waveform shaping circuit 311*c* (record L51).

In the case of receiving a WWVB standard frequency broadcast, the threshold level control circuit 317*c* sets the threshold level to a value rather higher than the intermediate value of the peak value and the bottom value mentioned above, and outputs a control signal to set the threshold level to a value of, for example, being 1.1 times as large as the intermediate value (record L53) to the waveform shaping circuit 311*c*.

In the case of receiving a DCF77 standard frequency broadcast, the threshold level control circuit 317*c* sets the threshold level to a value rather lower than the intermediate value of the peak value and the bottom value, and outputs a control signal to set the threshold level to a value of, for example, being 0.9 times as large as the intermediate value (record L55) to the waveform shaping circuit 311*c*.

Alternatively, the threshold level may be controlled according to a region (country) in which the wave clock 1*b* is used. In this case, the CPU 100 performs the processing of outputting the information pertaining to the region in which the wave clock 1*b* is used to the threshold level control circuit 317*c* in place of the processing at the Step b15 in FIG. 24.

What is claimed is:

1. A time reception apparatus comprising:

a reception unit to receive a standard frequency broadcast including time information composed of a plurality of pieces of data divided into every second;

a waveform shaping unit to perform waveform shaping of the standard frequency broadcast received by the reception unit to a time code signal expressed by binaries divided into every second;

a change time calculation unit to detect a change point at which the time code signal subjected to the waveform shaping by the waveform shaping unit changes in a divided period, and to calculate a time from a start of the period to the change point;

a decoding unit to judge data in the period divided into a second based on the time calculated by the change time calculation unit, so as to decode the time code signal subjected to the waveform shaping by the waveform shaping unit; and a time extracting unit to extract a time indicated by the time information in accordance with a decoded result by the decoding unit.

2. The time reception apparatus according to claim 1, wherein the change time calculation unit detects a change point at which the time code signal subjected to the waveform shaping by the waveform shaping unit changes last in the divide period, and calculates the time from the start of the period to the change point.

3. The time reception apparatus according to claim 2, wherein the waveform shaping unit comprises a synchronization signal generation unit to generate a synchronization signal output every second in synchronization with a time interval of the data of the time code signal based on the time code signal subjected to the waveform shaping, and the change time calculation unit detects a change point at which the time code signal changes last in a period of the synchronization signal output in every second generated by the synchronization signal generation unit, and calculates a time from a start of the period to the change point.

4. The time reception apparatus according to claim 1, wherein the change time calculation unit detects a change point at which the time code signal subjected to the waveform shaping by the waveform shaping unit changes first in the divided period, and calculates the time from the start of the period to the change point.

5. The time reception apparatus according to claim 4, wherein the waveform shaping unit comprises a synchronization signal generation unit to generate a synchronization signal output every second in synchronization with a time interval of the data of the time code signal based on the time code signal subjected to the waveform shaping, and the change time calculation unit detects a change point at which the time code signal changes first in a period of the synchronization signal output in every second generated by the synchronization signal generation unit, and calculates a time from a start of the period to the change point.

6. A wave clock comprising:

the time reception apparatus according to claim 1;

a time counting unit to count a time;

an output display unit to display the time counted by the time counting unit; and a time correction unit to correct the time counted by the time counting unit based on the time extracted by the time extracting unit.

7. The wave clock according to claim 6, wherein the change time calculation unit detects a change point at which the time code signal subjected to the waveform shaping by the waveform shaping unit changes last in the divided period, and calculates the time from the start of the period to the change point.

8. The wave clock according to claim 7, wherein the waveform shaping unit comprises a synchronization signal generation unit to generate a synchronization signal output every second in synchronization with a time interval of the data of the time code signal based on the time code signal subjected to the waveform shaping, and the change time calculation unit detects a change point at which the time code signal changes last in a period of the synchronization signal output in every second generated by the synchronization signal generation unit, and calculates a time from a start of the period to the change point.

9. The wave clock according to claim 6, wherein the change time calculation unit detects a change point at which the time code signal subjected to the waveform shaping by the waveform shaping unit changes first in the divided period, and calculates the time from the start of the period to the change point.

10. The wave clock according to claim 9, wherein the waveform shaping unit comprises a synchronization signal generation unit to generate a synchronization signal output every second in synchronization with a time interval of the data of the time code signal based on the time code signal subjected to the waveform shaping, and the change time calculation unit detects a change point at which the time code signal changes first in a period of the synchronization signal output in every second generated by the synchronization signal generation unit, and calculates a time from a start of the period to the change point.

* * * * *